US010293363B2

(12) United States Patent
Mitchell et al.

(10) Patent No.: US 10,293,363 B2
(45) Date of Patent: May 21, 2019

(54) PAINT ROLLER SYSTEM

(71) Applicant: Nour Trading House Inc., Waterloo (CA)

(72) Inventors: Jack Mitchell, Brighton (CA); Ming Zhang, North York (CA); Gary Isberg, Toronto (CA); G. David Church, Kitchener (CA)

(73) Assignee: NOUR TRADING HOUSE INC., Waterloo, ON ( * ) Notice: Subject to any disclaimer, the term of this patent is extended or adjusted under 35 U.S.C. 154(b) by 1028 days.

(21) Appl. No.: 14/406,094

(22) PCT Filed: Jun. 6, 2013

(86) PCT No.: PCT/CA2013/000544
§ 371 (c)(1),
(2) Date: Dec. 5, 2014

(87) PCT Pub. No.: WO2013/181743
PCT Pub. Date: Dec. 12, 2013

(65) Prior Publication Data

US 2016/0136679 A1 May 19, 2016

Related U.S. Application Data

(60) Provisional application No. 61/656,060, filed on Jun. 6, 2012.

(51) Int. Cl.

| | |
|---|---|
| ***B05C 1/08*** | (2006.01) |
| ***B05C 17/02*** | (2006.01) |
| *B44D 3/12* | (2006.01) |

(52) U.S. Cl.
CPC ..... *B05C 17/0217* (2013.01); *B05C 17/0245* (2013.01); *B44D 3/125* (2013.01)

(58) Field of Classification Search
CPC .. B05C 17/0217; B05C 17/0245; B44D 3/125
See application file for complete search history.

(56) References Cited

U.S. PATENT DOCUMENTS 4,077,082 A * 3/1978 Roe ..... B05C 17/02 15/230.11
8,025,022 B1 * 9/2011 Morris ..... A46B 7/10 118/258

(Continued)

FOREIGN PATENT DOCUMENTS

CA 2329284 A1 * 6/2001 ..... B05C 17/002

*Primary Examiner* — Shay Karls
(74) *Attorney, Agent, or Firm* — Daryl W. Schnurr; David J. Schnurr; Miller Thomson LLP

(57) ABSTRACT

The present invention is a paint roller system comprising a frame, a paint roller that may be supported by the frame. The frame may not include any moving parts. The paint roller may have end caps incorporated therein or connected thereto that may prevent liquids from entering the paint roller. The paint roller system of the present invention may be configured to prevent paint becoming lodged in elements of the paint roller system, and to prevent corrosion or plugging. The paint roller may rotate substantially freely when positioned within the frame. The paint roller system may be utilized to adhere paint to a surface with minimal effort or force being applied by a user. The paint roller system may include a paint roller container operable for storage of a paint roller as well as engagement and disengagement of the paint roller from the frame without the user handling the paint roller directly.

14 Claims, 30 Drawing Sheets

(56) References Cited

U.S. PATENT DOCUMENTS

| | | | | |
|---|---|---|---|---|
| 2007/0048068 | A1* | 3/2007 | Bullivant | A46B 11/0013<br>401/220 |
| 2007/0050935 | A1* | 3/2007 | Charbeneau | B05C 17/0217<br>15/230.11 |
| 2007/0295626 | A1* | 12/2007 | Mowe | B65D 81/261<br>206/361 |

* cited by examiner

PAINT ROLLER SYSTEM

FIELD OF THE INVENTION

This invention relates to paint roller systems. More particularly, this invention relates to a paint roller system incorporating a frame that does not include any moving parts and that incorporates a front loading engagement means for non-fixedly loading paint rollers.

BACKGROUND OF THE INVENTION

Paint roller systems generally comprise a frame and a paint roller. The frame and the paint roller may be fixedly integrated, or the paint roller may be removable from the frame. Each of the frame and the paint roller may be made up of numerous separate component parts. The paint roller of such systems is generally dipped in paint, and is used to transfer paint to a surface, such as a wall or other surface. Known prior art paint roller systems can be laborious to utilize as paint can work its way into parts of the frame, such as the connection between the roller and the frame, or other elements of the frame, such as moving parts in the frame. When paint becomes lodged in any of these elements of the paint roller system it can become difficult to achieve a rolling motion of the paint roller of the paint roller system. The application of paint on a surface can become uneven, and a significant amount of energy may need to be expended by the user to work the paint roller system.

U.S. Pat. No. 4,077,082 ("US 082") discloses an invention that is a roller cover support consisting of a blow molded sleeve having plural protruding ribs to frictionally retain the roller cover in place. The ends of the sleeve are molded to receive end caps which include suitable bearings for the roller frame shaft and provide some support against collapse or flattening out of the sleeve during use under pressure. A Y-shaped frame may be used that has spaced apart end supports that are substantially flat and thin, and are parallel to each other. The roller cover support is positioned between the frame supports. In order to dismount or mount the paint roller (with the roller cover support therein) from the frame the frame supports must be flexed apart. Continued use of prior art of this type results in the arms of the frame stretching from the continued flexing resulting in an unstable mounting of the paint roller within the frame, or breakage of the frame supports.

U.S. Pat. No. 7,404,228 discloses a yoke type paint roller frame having a pair of arms joined at one end. Each arm terminates at the opposite end and a paint roller of selected length can be positioned between these ends. Specifically the ends of the frame are inserted within the paint roller, so that the paint roller is engaged with the frame by way of stub axles. The ends of the frame are flexed so as to engage with a paint roller. A cross bar is connected to the frame to maintain the position of the frame ends once these are inserted into the paint roller to hold the frame ends in the paint roller. This invention is prone to having paint work its way inside the paint roller where the frame ends are inserted into the paint roller. This invention is also prone to having paint work its way into the cross bar and thereby interfere with the function of the cross bar.

U.S. Patent Application Publication No. 2007/0050935 describes a paint roller frame made from a single length of rod shaped to form a frame that can engage a paint roller. The frame includes arms having distal ends adapted to rotatably engage opposite ends of a paint roller. A distal segment may serve as an axle shaft about which a first roller engaging hub is journaled. In order to mount, or dismount, a paint roller to the frame, forces must be applied to spread the frame arms apart so as to allow the roller to be positioned between the frame arms. The frame is bent at two or three locations along its length so that it can be considered to consist of three or four segments. Continued use of this invention may result in the arms of the frame stretching from the continued flexing apart of the arms resulting in a poor mounting of the paint roller to the frame. Moreover, adherence of paint to the frame may diminish the ability of the bends in the frame to absorb shock forces created when painting occurs, as sections of the frame may become rigid due to paint becoming lodged in the sections. Also the use of the paint roller frame may compromise the bends in the frame. All of these effects of use upon the frame may diminish the integrity and ease of use of the frame.

SUMMARY OF THE INVENTION

In one aspect, the present disclosure relates to a paint roller system for applying a liquid material to a surface, said paint roller system comprising: a frame devoid of moving parts incorporating two frame arms that are connected at one end, said frame arms being positioned to be virtually parallel to each other and each frame arm having a frame engagement means incorporated therein; a paint roller having an end piece incorporated in each of two outer roller ends that are positioned virtually parallel to each other, the end pieces being operable to prevent liquid from entering the paint roller, each end piece incorporating an end engagement means connectable to the frame engagement of at least one of the two frame arms, and the paint roller being positionable between the frame arms when each end engagement means is connected to one of the frame engagement means and freely rotatable in said position; and a handle attachment incorporated in the frame extending from the connection between the frame arms.

In one embodiment of said paint roller system of the present invention, the liquid material is any of the following: paint; a coating; a wash; plaster; or any other liquid substance that is applicable to a surface.

In one embodiment of said paint roller system of the present invention, the frame incorporates any of struts, cut-outs or reinforcement pieces, or any combination thereof, that are formed and incorporated in the frame to maintain rigidity and flexibility requisite to cause even weight distribution from the frame to the surface, so that there is even distribution of the liquid material to the surface with minimal force exerted by a user.

In one embodiment of said paint roller system of the present invention, the paint roller system is resistant to corrosion or plugging by any liquid material it contacts, including any of the following; paint, solvents, acid, water, bases, or any other agents that come into contact with the paint roller system.

In one embodiment of said paint roller system of the present invention, each of the end engagement means incorporates a stub shaft, and each of the frame engagement means incorporates an indentation formed in each frame arm, said indentation being a shape and size to receive the stub shaft. Moreover, the indentation is formed to be narrower than the stub shaft at the end where the stub shaft is introduced to the indentation when the end attachment means is connected to the frame attachment means.

In one embodiment of said paint roller system of the present invention, a slit is formed in the outer portion of at least one of the frame arms so that the slit extends into at least a portion of the frame attachment means, said slit flexes the frame arm by widening when the frame attachment means is connected to or disconnected from the end attachment means and returns to its original size after the connection or the disconnection has occurred, said slits being operable to prevent the paint roller from slipping or unexpectedly disengaging when the paint roller is positioned within the frame.

In one embodiment of said paint roller of system of the present invention, the connection between the end engagement means and the frame engagement means is a snap connection.

In one embodiment of said paint roller system of the present invention, the paint roller is connected to the frame by front-loading and may be connected through force applied to the frame when the paint roller is positioned in proximity to the ends of the frame arms distant from the connection of the frame arms in the frame.

In one embodiment of said paint roller system, the handle attachment is formed to connect with a handle, whereby the handle is removeably connected to the frame, or the handle attachment is a handle, and the handle attachment is formed at an angle configured to achieve an optimum application of the liquid material to the surface and for comfort of a user gripping the handle.

In one embodiment of said paint roller system of the present invention, the end pieces are formed of polypropylene resin.

In one embodiment of said paint roller system of the present invention, the angle of the frame arms in relation to the paint roller when the paint roller is positioned between the frame arms is formed to prevent contact between the frame arm and any surface adjacent to the surface to which the liquid material is applied.

In one embodiment of said paint roller system of the present invention, the paint roller is rotatable freely around an axis of the end pieces when the paint roller is connected to the frame, and the paint roller is rotatable in a clockwise direction and in a counter-clockwise direction.

In another aspect, the present disclosure relates to a paint roller system for applying a liquid material to a surface and storing a paint roller of the paint roller system when such paint roller is not in use, said paint roller system comprising: a frame devoid of moving parts incorporating two frame arms that are connected at one end, said frame arms being positioned to be virtually parallel to each other and each frame arm having a frame engagement means incorporated therein; two end pieces incorporating an end engagement means connectable to the frame engagement of at least one of the two frame arms; the paint roller having two outer roller ends positioned virtually parallel to each other, each roller end being formed to receive one of the two end pieces in a manner that prevents liquid from entering the paint roller when the two end pieces are inserted each in one of the two roller ends, and the paint roller being positionable between the frame arms when each end engagement means is connected to one of the frame engagement means and freely rotatable in said position; a handle connection means incorporated in the frame extending from the connection between the frame arms; and a paint roller container formed to enclose and encompass the paint roller when said paint roller is not in use and said paint roller is positioned within the paint roller container.

In one embodiment of said paint roller system of the present invention, the paint roller is an off-the-shelf paint roller.

In one embodiment of said paint roller system of the present invention, the paint roller container is formed of a transparent material.

In one embodiment of said paint roller system, the paint roller container incorporates: slots formed in the side walls wherein the end engagement means of the end pieces are positionable; and an engagement means operable when the paint roller container is in a closed position to securely enclose the paint roller within the paint roller container.

In another aspect, the present disclosure relates to a method of using a paint roller system for applying a liquid material to a surface and for storing a paint roller of the paint roller system when such paint roller is not in use, said method incorporating the following steps: connecting one of two end pieces to each of two ends of a paint roller, each end piece having an end engagement means incorporated therein and preventing liquid material from entering the interior of the paint roller by the connection of each of the two end pieces to each of the two ends of the paint roller; attaching a paint roller to a frame that is devoid of moving parts by connecting each of the end engagement means to frame engagement means incorporated in each of two frame arms incorporated in a frame in a manner that allows the paint roller to rotate freely when positioned between the two frame arms of the frame; a user moving the frame to cause the paint roller to be introduced to a liquid material; moving the frame to cause the paint roller to contact a surface and thereby apply the liquid material to the surface; disengaging the frame from the paint roller by applying force to the frame to cause the frame attachment means to disconnect from the end engagement means on each of the two ends of the paint roller; and storing the paint roller in the paint roller container.

In one embodiment of said method of the present invention, further steps are incorporated of: positioning the paint roller within a paint roller container that is in an open position by moving the frame to so position the paint roller; encompassing the paint roller in the paint roller container by moving the paint roller container to a closed position; and disengaging the paint roller from the frame.

In one embodiment of said method of the present invention, further steps are incorporated of: engaging the paint roller with the frame by positioning the paint roller within the paint roller container that is in a closed position to be in close proximity with the frame and applying pressure to connect the end engagement means and the frame engagement means; moving the paint roller container to an open position; and moving the frame so as to remove the paint roller from the paint roller container.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Such description makes reference to the annexed drawings wherein.

Figure 1:
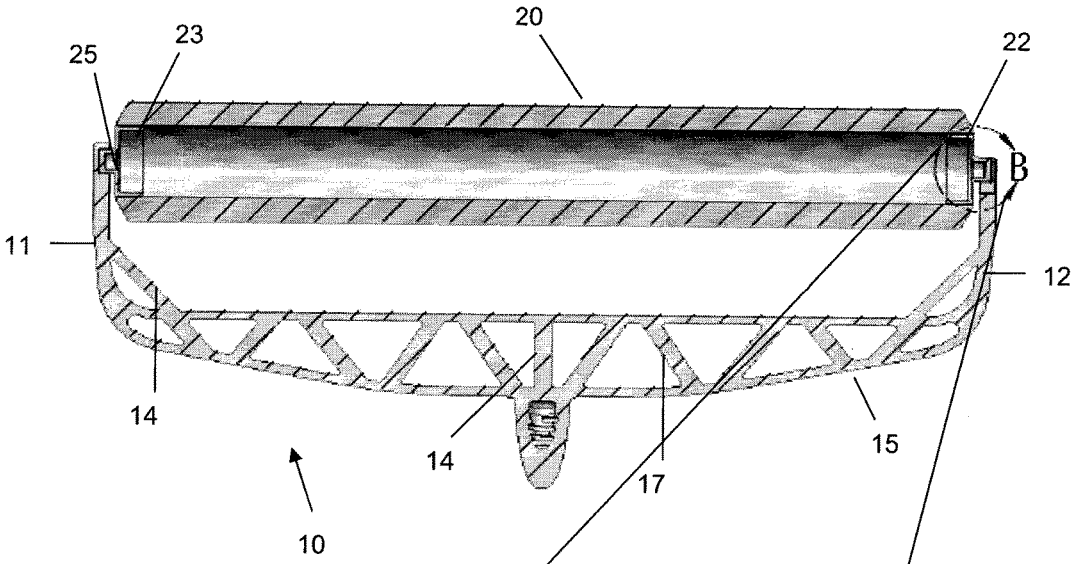
FIG. 1 is a front cross-sectional view of a paint roller frame with assembled paint roller in accordance with an embodiment of the present invention.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE INVENTION

The present invention is a paint roller system comprising a frame that may be made up of a single piece component and a paint roller that may be supported by the frame. The frame may not include any moving parts. The paint roller may include end pieces, for example, such as end caps, connectable to the ends of the paint roller to substantially prevent agents such as paints, solvents, water or other agents from entering the paint roller. The paint roller system of the present invention may be easy to clean and may be formed to prevent paint from becoming lodged in any element of the paint roller system, as well as any corrosion or plugging of the paint roller system. The paint roller system may therefore be reliably utilized in a manner whereby the paint roller rotates substantially freely within the paint roller frame to adhere paint to a surface with minimal effort or force being applied by a user. The paint roller system may include a paint roller container operable for storage of a paint roller as well as engagement and disengagement of the paint roller from the frame without the user handling the paint roller directly.

Herein a reference to "paint" is utilized to include any type of substance that may be applied to a surface, including paint, washes, coatings, plaster, or any other substance.

The frame of the present invention may be shaped with two arms extending from a common base section that may be substantially parallel arms or may be angled arms. Embodiments of the present invention may include a frame that is virtually Y-shaped, U-shaped or V-shaped. The arms may each incorporate an engaging means, whereby each arm may engage an end of a paint roller positioned between the arms. For example, each engaging means may create a connection between an arm and an end piece, such as an end cap, fitted within the end of the paint roller.

In embodiments of the present invention, the end cap may function to prevent paint or any other liquid from entering the paint roller. The portion of the paint roller that is utilized to adhere paint to a surface may rotate freely around an axis defined by each end piece. The end piece may not be required to rotate within the engaging means, rather the outer edge of the paint roller may rotate around the end piece. The end piece may be virtually flush with the edge of the paint roller. In this manner paint may be prevented from entering the paint roller. Therefore, the paint roller may not be restrained from free rotation by any gumming effect of paint or other substances. Free rotation by the paint roller may cause the user to be able to utilize the paint roller system with minimal effort or force, and the paint may be evenly applied to a surface by the paint roller system.

The frame of the present invention may incorporate cut-outs therein, or may include reinforcement pieces or struts. The cut-outs, reinforcement pieces or struts may be formed to maintain the shape, angle and integrity of the frame during use. The cut-outs, reinforcement pieces or struts may also be formed to decrease the overall weight and bulk of the frame. For example, an embodiment of the present invention that includes a solid piece frame may be significantly heavier and bulkier than an embodiment of the present invention that includes a frame incorporating cuts-outs, reinforcements pieces or struts.

The cut-outs, reinforcement pieces or struts may also be incorporated in the frame in a manner whereby the frame will be formed to absorb force and shock occurring during use of the paint roller system without losing its shape or experiencing diminished integrity during use over time. The cut-outs, reinforcement pieces or struts may further be formed to cause the frame to be flexible, to absorb shock, and to work to adhere paint to uneven surfaces in a substantially even manner.

A handle section may be connected to an extend from the base of the frame. The handle section may be positioned at an optimum angle in relation to the frame to cause maximum contact between the paint roller and a surface during use of the paint roller system, and for such contact to be even so that the paint is evenly applied to the surface, with minimum effort or force being exerted by the user. The angle of the handle section may further be in accordance with specific requirements, such as ergonomic requirements to create ease of use of the system by a user. In embodiments of the present invention the handle may be extendable.

In other embodiments of the present invention the base of the frame may incorporate a connection means whereby a handle or other piece, grip, element or extension section may be connected to the frame in a fixed or releaseable manner. A skilled reader will recognize the variety of connection means that may be utilized to attach a handle, either fixedly or releasably, to the frame of the present invention.

A skilled reader will further recognize that a variety of handle types, lengths, and grips, or pieces, or extension of varying types lengths and features, may be incorporated in the present invention, and that these may achieve a variety of outcomes to assist with painting requirements based on the shape of the surface to be painted (including height, width, curved edges, and other formation considerations), type of paint to be adhered to a surface, ergonomic considerations, and other requirements of a painting user in order to paint a surface.

In some embodiments of the present invention the paint roller may be a customized paint roller and end caps of the present invention may be incorporated in the paint roller. In other embodiments of the present invention the paint roller may be an off-the-shelf paint roller that has end caps of the present invention connected thereto. Using an off-the-shelf paint roller may cause the present invention to be cost-effective to use and prevent backlogs during a project that may otherwise be caused by a lack of any required customized paint roller section or by waiting for such a customized item to be delivered.

In one embodiment of the present invention, the paint roller system comprises: paint roller frame and a paint roller. The paint roller may have an end piece inserted in one or more of the ends of the paint roller. The end piece may include an engaging means, for example, such as a stub shaft disposed at respective opposite ends of the paint roller. The paint roller frame may be formed to incorporate a pair of spaced apart side arms. The arms may be substantially parallel. Each side arm may incorporate an engaging means for engaging the engaging means of an end cap. For example, each side arm may incorporate engaging means, such as an indentation, for engaging an end cap engaging means, such as a stub shaft incorporated in the end cap. A skilled reader will recognize that a variety of engaging means may be formed in each end cap and each side arm, whereby a paint roller having an end cap incorporated or otherwise connected to an end of the paint roller may be non-fixedly and removeably connected to the side arm.

Each arm of the frame may include a top edge and a side wall. A slit may be formed in the top edge and may extend through a portion of the side wall. The slit may be configured for receiving an engaging means of an end cap, for example, such as a stub shaft. When each end of the paint roller is connected to an end cap and the end caps are each connected to one of the side arms, the paint roller may be positioned between the side arms and may be able to rotate freely.

Each side wall may be tapered towards the top edge to permit sliding insertion of the engaging means of the paint roller so as to hold the paint roller in position within the frame. The frame may include one or more side arms that incorporate tapered side walls that include a relief cut extending from the top edge and along the side walls.

In one embodiment of the present invention the frame may include a strut extending from the base portion of the frame to a side arm. A strut in virtually a mirror position may be incorporated in the frame to engage with the opposite side arm. The frame may incorporate other cut-outs, struts or reinforcement pieces along the base portion of the frame.

The present invention offers several advantages over the prior art. For example, the present invention may avoid the drawbacks of prior art devices by providing a paint roller system that comprises a frame that supports a replaceable paint roller which is simple to fabricate as it does not include any moving parts, formed to be durable, easy to assemble, and is not prone to paint getting into the elements of the paint roller system, or to paint build-up in the paint roller system. Prior art systems can include moving parts, often for adjusting aspects of the paint roller or frames of such systems, and can be difficult to fabricate and assemble due to the many parts.

Prior art frames are often produced from materials, such as non-durable plastics, that break or lose their shape with use. Prior art frames are generally created to include elements wherein paint can become lodged in parts of the frame causing the use of the paint roller to become compromised and laborious for the user. The present invention overcomes these disadvantages of the prior art.

The present invention also provides a benefit over the prior art in that it incorporates a paint roller frame formed to be a single piece component that does not include any moving parts. The prior art frames incorporate moving parts and multiple elements. Paint builds-up in the parts and can plug the parts of the prior art and cause the prior art to be difficult to use and require significant force to utilize. The form and configuration of the frame of the present invention substantially prevents agents such as paints, solvents, water or other agents from corroding, plugging, or preventing the paint roller from rotating freely. These are problems that affect the prior art.

Referring now to FIG. 1, there is shown an assembly of a paint roller system of the present invention 10, incorporating a paint roller 20 positioned within two arms 11, 12 connected by a base portion 17 of a paint roller frame. The paint roller 20 may generally include end pieces that are end caps 22, 23 disposed at respective opposite ends of the paint roller 20. The end caps may include engaging means, such as stub shafts, whereby the each of end caps engage with one of each of the arms of the frame.

The frame may be formed to be rigid to provide significant strength. Means of stiffening the frame may be incorporated in embodiments of the present invention, such as cut-outs, struts and reinforcement portions, as is disclosed herein. The rigidity, integrity and flexibilities of the system of the present invention, and in particular of the frame, may be configured to provide for even paint distribution on surfaces to which paint is applied with minimal force exertion by a user. Therefore, the design of the frame and the system generally is such that force is distributed evenly over the frame and the paint roller when a user utilizes the system. The design of the system may further create even weight distribution from the frame to the surface being painted so as to reduce roller lines being produced on the painted surface as the paint is applied thereto.

The frame is configured so that it does not include any moving parts. Moving parts can become gummed up with paint and either cease to function or require increased force by a user to cause such parts to function. Therefore the frame of the present invention that does not include any moving parts will not be negatively affected by contact with paint.

The present invention does not include any seals or bearings. Therefore, the present invention generally does not include any aspect or element that may be corroded, plugged or prevented from functioning with ease by any paint, solvents, water or other agents with which the system may come into contact or build-up thereof.

Figure 2:
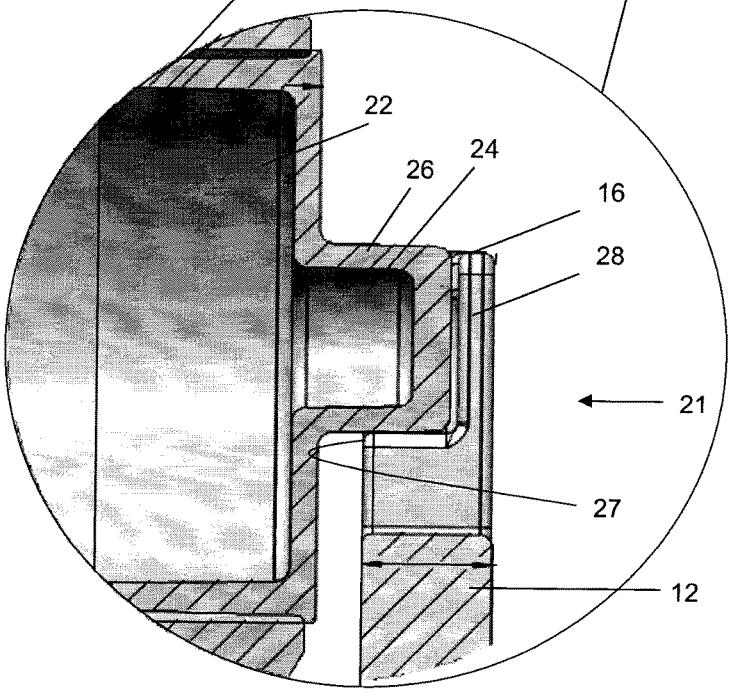
FIG. 2 is a close-up cross-sectional view of the connection between the paint roller and a frame end of the paint roller frame in accordance with an embodiment of the present invention.

For example, as shown in FIG. 2, the engaging means of one of the end caps 22 may include a centrally disposed stub shaft 24. The stub shaft may be operable to engage with an engaging means of the arm 12 of the frame. The engaging means of the end cap and the arm may be operable to achieve coupling between the frame and the paint roller that has the end cap incorporated therein. A skilled reader will recognize that although one form of engaging means is shown in the figures that other engaging means may be incorporated in the present invention for the purpose of engaging the end caps inserted in the ends of the paint roller with the arms of the frame so that the paint roller is positioned between the arms of the frame.

In one embodiment of the present invention the end caps may formed to be attachable to conventional off-the shelf paint rollers by a user. In such an embodiment the end caps are provided as individual units separately from the paint roller. The off-the shelf paint roller may be provided as an individual unit. The user may insert the end caps into the ends of the paint roller. When the end caps are inserted into the ends of the paint roller the end caps may be removeably connected to the paint roller.

In another embodiment of the present invention, the paint roller may be formed to incorporate end caps. In such an embodiment the end caps may be removeable, or may be fixedly attached to or otherwise incorporated in the paint roller.

As shown in FIG. 2, a portion of the end cap 22 may be positioned inside the paint roller when it is incorporated with or otherwise connected to the paint roller. The outer edge of the end cap may be virtually flush with the end of the paint roller into which the end cap is inserted so as to be connected and incorporated. The connection between the inner wall of the paint roller and the outer wall of the end cap that is in contact with the inner wall of the paint roller when the end cap is inserted in the paint roller is such that the end cap prevents paint or other liquid from entering the interior of the paint roller. Moreover, the contact between the inner wall of the paint roller and the outer wall of the end cap may be sufficiently close so that the end cap will not fall out of the paint roller. Once connected to a paint roller an end cap may be removeable therefrom by a user.

In one embodiment of the present invention, as shown in FIG. 2, an end cap 22 and the engaging means incorporated therein, for example, such as stub shaft 24, may be covered by a protective layer 26 or coating. The protective layer 26 may serve to prevent agents such as paints, solvents, water or other agents from corroding, plugging, or preventing the paint roller from turning freely. The protective layer may thereby increase the resistance to liquid of the end caps and the paint roller, so that the protective layer works to prevent paint or other liquid from entering the interior of the paint roller. The protective layer may be formed of a plastic material, or any other liquid resistant or repellent material, for example, such as of polypropylene resin.

In embodiments of the present invention, the end caps may be created wholly from a plastic or other liquid resistant or repellent material. The end caps may also be created from a material that is resistant to chemical solvents, bases and acids. As an example, the end caps may be formed from a material such as polypropylene resin.

Figure 9:
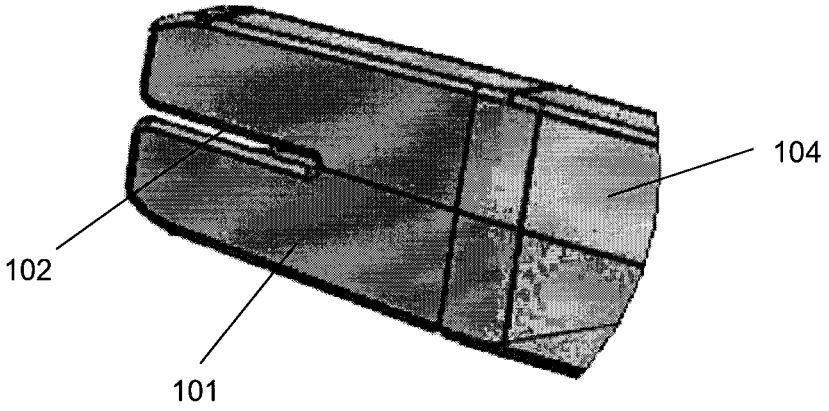
FIG. 9 is a side perspective view of an edge portion of a frame arm having a slit formed therein in accordance with an embodiment of the present invention.

The side arms of the frame may incorporate engaging means to each engage with an end cap in a portion near the top edge of the side arms, such as a frame end section, said frame end section being distant from where the arm meets the base of the frame. Each of the frame ends may incorporate an engagement means for receiving and connecting with the engagement means of a paint roller end cap. As shown in FIG. 2, an arm 12 or the frame may include a frame end 21 that includes a top edge 16 and a side wall 28. A slit may be formed in a portion of the frame end. The slit may extend from the top edge through the side wall and may be parallel to the side edge of the frame in some embodiments of the present invention. An example of the slit in an edge section is shown in FIG. 9. The frame end 104 has a slit 102 formed in side wall 101.

As shown in FIG. 2, a portion of the side wall 28 may be of a diminished thickness compared to other portions of the arm. This portion of the sidewall may define an indentation 27, recession, or other depression or channel, as required to form the engagement means in the inner side of the frame end portion of the frame arm. The width of the indentation may be less than the width of the frame arm. The indentation may be formed so that the engagement means incorporated in the end cap may be positioned within the indentation. Specifically, the indentation may be the size required to receive and otherwise engage the engagement means incorporated in the end piece, so that the end piece and the frame arm can thereby be connected.

Figure 4:
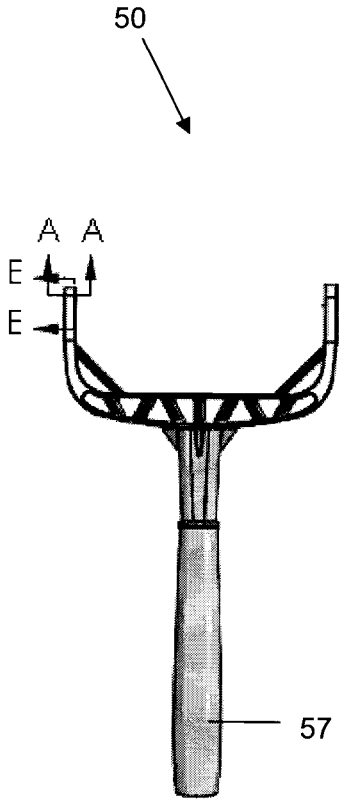
FIG. 4 is a front view of a paint roller system with a handle in accordance with an embodiment of the present invention.
Figure 5:
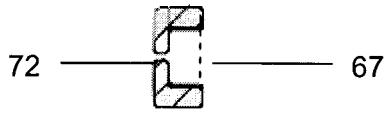
FIG. 5 is a top cross-sectional view of an indentation and a slit formed in an inner wall of an edge portion of a frame arm a roller paint system in accordance with an embodiment of the present invention.

As shown in FIG. 4, the frame end of an arm of the frame may include section A-A and section E-E. A view of section A-A is shown in FIG. 5, wherein an indentation 67 is shown to be formed within the inner wall of the edge portion of the frame arm. The width of the indentation is less than the width of the frame arm. The indentation is formed within the portion of the frame arm having a slit 72 formed therein. In one embodiment of the present invention a stub shaft of an end cap may be fit within the indentation of the frame arm to be thereby connected to the frame arm.

Figure 6:
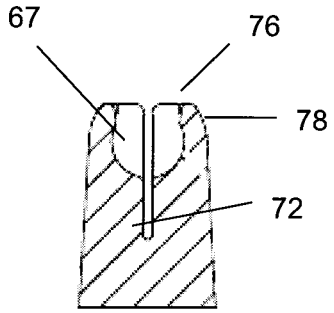
FIG. 6 is a side cross-sectional view of an indentation and a slit formed in an inner wall of an edge portion of a frame arm a roller paint system in accordance with an embodiment of the present invention.

Section E-E is shown in FIG. 6, wherein a side wall 78 of an edge section of a frame arm is shown to have a slit 72 formed therein. The side wall further has an indentation 67 incorporated therein. The side wall may be tapered so as to be narrower at the top edge 76. The indentation may further extend to the top edge. The indentation may be narrower where it reaches the top end than at the lower edge of the indentation that is positioned away from the top edge and closer to the base section of the frame. At the top end the indentation may be slightly narrower than the width of the end cap engagement means, such as the width of the stub shaft.

The slit may provide some flexibility whereby the top edge of the frame arm may expand along the slit, so as to widen the slit, to receive the engagement means of the end cap. For example, the slit may widen when the stub shaft of the end cap passes through the top end of the indentation. The slit may further retract to hold the engagement means of the end piece in place once it has engaged the engagement means. For example, after the stub shaft of the end cap has passed through the top end of the indentation where the indentation is narrower than the width of the stub shaft and the stub shaft is fitted within the portion of the indentation that is at least as wide as the stub shaft, the slit may retract.

The slit may further allow for the connection between the engagement means of the end piece and the frame arm to occur without damage to the frame arms. For example, the slit may cause the engagement means of the frame arm to be snappably connectable to the engagement means of the end cap. The connection of the end cap to the frame end may involve snapping the stub shaft into, and out of, the indentations in the frame arm. The slit may provide flexibility to the side walls of the frame arms so that when the engagement means of the end piece and the frame arms initiate or terminate contact any tension created by these activities may be absorbed by movement of the side walls. The slit may widen when the tension occurs and retract when tension lessens. In this manner the side walls portions in the frame end that are divided by the slit may be moved father apart when the slit is widened, and closer together when the slit retracts. The side walls may be flexible to widen or diminish the width of the slit as is required for such absorption of tension to occur.

The engagement means shown in FIG. 2 is a snapable connection means. The stub shaft of the end cap snaps into the indentation in the frame arm.

Embodiments of the present invention may incorporate a snapable engagement means between both of the end caps and frame arms in the paint roller system. Other embodiments of the present invention may only incorporate a snapable engagement means between one of the end caps and one of the frame arms.

The frame may be formed from a variety of materials, including metals, plastics, and other materials having the strength and flexibility required to sustain tension occurring when the present invention is in use for rolling paint onto a surface and to allow for the use of an engagement means to connect the end pieces to the frame arms. The material from which the frame is formed may be resistant to abrasive or corrosive liquids, for example, such as chemical solvents, bases and acids. The material of the frame may be durable. In some embodiments of the present invention, the frame may be formed of multiple materials so that portions of the frame, such as the base of the frame, the handle connection, the struts, cut-outs, frame arms, or other portions may be formed of different materials from other portions of the frame. Materials may also be combined or layered to form the frame.

In one embodiment of the present invention, the slit may permit sliding insertion of an engagement means of the end cap, for example, such as a stub shaft of the end cap. Once the engagement means is connected with the engagement means of the frame arm, for example, such as an indentation in the frame arm, the connection of the frame arm and end cap achieved by the engagement means may function to hold the paint roller in a position between the frame arms. Once the paint roller is connected to the frame arms by the end cap engagement means, the paint roller may rotate freely around an axis of the end caps, and the paint roller may be prevented from detaching from its connection with the frame ends through the end caps.

The rotation of the paint roller may be either in a clockwise direction or a counter clockwise direction as indicated by B shown in FIG. 1.

In one embodiment of the present invention, the engagement means may be formed so that the paint roller may be front loaded into connection with the frame arms through the end caps. In this manner when the end cap that is connected to the paint roller the engagement means in the end cap may be inserted into an engagement means incorporated in the frame arm from a frontwards direction. To be loaded from a frontwards direction the paint roller may be connected to the frame by way of the end caps from the top edge of the frame arms when the frame is standing upright on its handle, or handle connection. The paint roller may be pushed down into the top edge of the upright frame and this pushing action shall cause the engagement means of the frame arms and end caps to become connected.

The front loading aspect of the invention will cause resistance in the frame to work to prevent the roller from falling out of the frame. When a paint roller rotates within the frame the strongest of the rotation forces may be applied to the back of the frame. The frame may be formed to be strongest in the area where the rotation forces will be applied to the greatest strength. For example, the diameter of the frame end may be slightly smaller at the insertion point than the diameter of the attachment means, for example, such as the stub shaft, of the end piece, as is shown in FIG. 6. This shaping can cause resistance that works to prevent the engagement means of the end piece that is incorporated in the paint roller to keep from slipping out of the intended connection with the engagement means of the frame end. A skilled reader will recognize that other engagement means may incorporate shapes and formations to create a means to prevent the end pieces from disengaging with the frame ends, to thereby keep the paint roller engaged with the frame.

For example, pushing down shall cause the stub shafts of the end caps to be moved into the indentation in the frame ends of the frame arms by passing through the indentation section that meets the top edge of the frame end first and then passing into the indentation generally. In this manner the stub shafts pass through the top end of the indentation that may be narrower than the stub shaft before passing into the section of the indentation that is at least as wide as the stub shaft. When the tension is greatest during the pushing down, which is when the stub shaft is passing through the top end narrower section of the indentation, the slit may expand and widen in reaction to tension upon the walls of the top end narrow section of the indentation. By widening the slit may decrease the tension and may thereby assist the stub shaft to move past the narrow opening of the indentation near the top edge of the frame arms. The slit may retract and become less wide once the stub shaft is positioned within the wider portion of the indentation. The narrower opening of the indentation may then acts to keep the stub shaft positioned within the indentation because the stub shaft cannot pass through the narrow opening within force and tension to widen the slit.

In embodiments of the present invention, it may be possible to pushing connect the end caps to the frame ends, by pushing the paint roller down onto the paint roller frame. It may also be possible to connect the end caps to the frame ends by positioning the paint roller beneath the paint roller frame and pushing the paint roller frame down towards the paint roller. This may be useful to allow for the connection of a paint roller to the paint roller frame without the need to touch a paint roller, which may be preferable if the paint roller has paint thereon. Pushing to achieve a connection between the end caps and the paint roller frame may be applied to an embodiment of the present invention that incorporates a snappable engagement means between both frame arms and end caps. However, other connection activities may be utilized with other embodiments of the present invention that incorporate only one snappable engagement means between one end cap and frame arm of the present invention, as disclosed herein.

The length of the slit formed in the side wall of the frame arm may affect the resistance created at the end of the frame arm. For example, a longer slit may create less resistance in the end of the frame arm, and a smaller slit may create more resistance in the end of the frame arm. A skilled reader will recognize that embodiments of the present invention may incorporate slits of varying lengths to achieve optimum or otherwise required resistance. Slits may also be a variety of shapes, as disclosed herein.

In other embodiments of the present invention the engagement means of the end caps and the frame arms may function so that the paint roller is loaded from a direction other than a frontwards direction. A skilled reader will recognize that various engagement means may be formed in the end pieces and frame arms to require loading of the paint roller onto the frame from directions other than a frontwards direction.

In one embodiment of the present invention, the frame may be formed so that the frame arms are substantially parallel with each other and a paint roller connected to the frame may be positioned to be extended between the frame arms. In some embodiments of the present invention, when a paint roller is connected to the frame arms, the frame arms may be angled from the base section of the frame, for example, such as angled between about 2 to 10 degrees. The angle formed in the frame arms may be chosen to prevent the paint frame from "scrubbing" or otherwise rubbing or contacting the frame arm on any surface adjacent to the surface being painted, for example, such as when a user is painting close to the corner of a wall.

In another embodiment of the present invention, the arms of the paint roller frame are not angled. This embodiment may further incorporate a wall spacer element, to prevent contact of the frame with a surface being painted, as discussed herein.

In one embodiment of the present invention only one engagement means of the frame arms may incorporate a slit, and/or any taper. The end cap at the end of the roller that does not connect to a frame arm having a slit and/or taper therein may be connected first, and then the engagement means of the other end of the paint roller end cap may be connected to the engagement means in the frame arm that incorporates a slit and/or taper. In this manner only one engagement means of the frame arms may snap into place, as discussed herein. Both end caps will connect to the frame arm and create a connection that holds the paint roller between the frame ends.

In an embodiment of the present invention, there may be no tension applied to the paint roller or the end caps. This lack of tension may allow the paint roller to rotate freely once the paint roller is engaged with and fitted into the frame.

In one embodiment of the present invention, one or more of the engagement means may cause one or both of the end caps to be held stationary when the engagement means of the end caps and the frame arms are connected.

In an embodiment of the present invention, after the end caps are connected with the paint roller and the end caps are connected to the frame arms there may be no or virtually no tension in the frame arms. Tension may impede the free rotation of the paint roller, and therefore the lack of tension may facilitate that free rotation of the paint roller.

Figure 3:
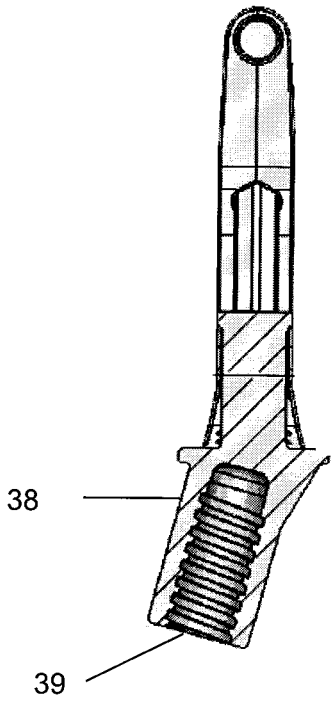
FIG. 3 is a side cross-sectional view of the handle connection section and an arm of a paint roller frame in accordance with an embodiment of the present invention.

In one embodiment of the present invention, the paint roller frame may incorporate a handle connection section 38, as shown in FIG. 3. The handle connection section 38 may extend from the base section of the frame, as shown in FIG. 1. The handle connection section 38 may incorporate a handle connection means whereby a handle piece, extension, grip, or other piece may be connected to the handle connection section. For example, as shown in FIG. 3, the handle connection section may incorporate a threaded handle connection means 39, whereby a handle piece, extension, grip, or other piece having a suitable connection means may be engaged with the threaded handle connection means of the handle connection section and thereby be connected to the frame. The connection between the handle connection section and a handle piece, extension, grip, or other piece may be fixed or releaseable.

A skilled reader will recognize that a variety of handle connection means may be incorporated into the present invention, such as a snap in means, a threaded means, a glued means, a nailed means, a magnetic means, a merged means (for example, such as is achieved by way of welding), a clip-on means, or any other fixed or releasable connection means. A friction-based connection means may also be utilized, for example, such as cantilever designs, spring loaded designs or combinations thereof, and matching apertures designed to detachably receive the coupling member.

A skilled reader will also recognize that a variety of types of handles or other pieces may be connected to the present invention to achieve various types of tasks, for example, such as of varying lengths, having ergonomic features, having particular handle components (such as slip-proof grips, or padded grips, or other types of grips or other components), of varying flexibilities, of varying thicknesses or widths, or any other type of handle, extension, grip, or other piece.

In another embodiment of the present invention, a connection means may extend from a handle portion incorporated in the frame. For example, a hand portion may incorporate a threaded connection means whereby an extension, additional grip, or other piece may be connected to the handle.

Figure 8:
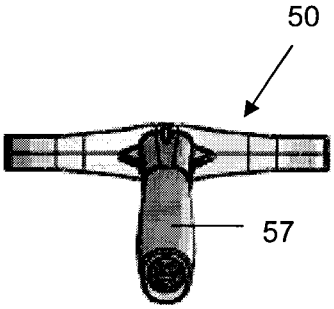
FIG. 8 is a perspective view from a lower end of a roller paint system with a handle connection section in accordance with an embodiment of the present invention.

In yet another embodiment of the present invention, the handle portion 57, or handle connection means, may be connected to the frame 50 so as to be angled in relation to the lower section of the frame and the frame arms, as shown in FIGS. 8 and 9. For example, the angle may be approximately 10 to 20 degrees, or any other angle configured to achieve an optimum application of paint to a specific surface. The angle may further be configured to permit a user to have an increased view of the surface to which paint is to be applied, such as when paint is applied to a surface that is overhead. The angle may still further be configured to allow for ease and comfort to be experienced by a user utilizing the system to apply paint to a surface.

Figure 7:
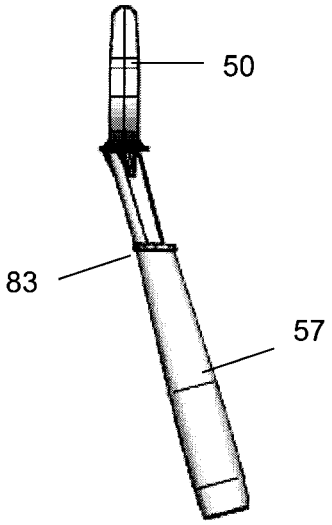
FIG. 7 is a side view of a roller paint system with a handle in accordance with an embodiment of the present invention.

As shown in FIG. 7, in one embodiment of the present invention the handle portion 57 may incorporate a collar 83. The collar may be disposed at a distance from the lower portion of the frame. The collar may serve to prevent the handle portion from entering the paint roller tray once the paint roller system is set down in the paint roller tray.

In another embodiment of the present invention, as shown in FIG. 4, the paint roller system 50 may incorporate a handle portion 57. The handle portion may further incorporate a grip portion, and the handle may be of any type or length as may be required for painting. The handle portion may be adjustable, so that the angle between the handle and the frame may be adjusted, or the length of the handle may be extended, in accordance with known means.

In some embodiments of the present invention, the frame may be formed to incorporate cut-out sections, struts or reinforcement portions. These aspects of the present invention may provide structural integrity to the frame, may cause the frame to be lighter than a solid piece frame without any cut-outs while preserving the integrity of the frame, and may provide for some flexibility in the frame for the purpose of absorbing shock or tension to ensure optimum coverage and consistency in application of paint to a surface while a user is painting.

In an embodiment of the present invention that incorporates one or more struts, as shown in FIG. 1, such struts 14 may connect the frame arms 11, 12 with base portion 15 of the frame.

In an embodiment of the present invention that incorporates one or more reinforcement portions, such reinforcement portions 17, 18 may be positioned between sections of the base portion 15 of the frame, as shown in FIG. 1.

A skilled reader will recognize that the struts and reinforcement portions may be positioned within other sections and portions of the frame of the present invention. For example, struts or reinforcement portions may be positioned to connect the base portion of the frame with the handle portion of the frame. Struts or reinforcement portions may be connected to the frame sections, said frame sections being formed of a continuous piece of material. For example the frame may be formed of a single piece of material to include two arms, and a base section that includes upper and lower rungs. The struts and reinforcement portions may be positioned between the upper and lower rungs, or between the arms and the base section of the frame. A skilled reader will recognize that embodiments of the present invention may have various configurations in accordance with a variety of desired results for specific painting purposes.

Another embodiment of the present invention may incorporate cut-out sections, whereby sections of the frame are cut out of the frame. In such an embodiment of the present invention the frame may be formed of a single piece of material and sections are cut-out of the frame. The cut-out sections may achieve various integrities, strengths and flexibilities within the paint roller system. In yet another embodiment of the present invention, the frame may incorporate any combination of cut-out sections, struts and/or reinforcement portions.

Struts and reinforcement portions may be incorporated or otherwise attached to the present invention to provide the frame with greater strength and flexibility, as may be required for some painting uses. Placement of cut-outs, struts and/or reinforcement portions may be configured to achieve even paint distribution.

In one embodiment of the present invention, one or more struts may be placed at an angle, for example, such as an angle of approximately 45 degrees to the side arms and/or to the base of the frame. A skilled reader will recognize that the angle of the struts or reinforcement portions may be configured depending on the size of frame and tension desired.

The configuration of the present invention may be such that increased pressure is applied to the paint roller when a user is painting over that achieved by the prior art even if the user force applied is the same. This has the effect that the present invention may apply greater pressure to the paint roller while maintaining even paint distribution across the front of the roller. This may be achieved for a variety of embodiments of paint roller systems of the present invention, including various sizes of paint roller frames to be used with a variety of sizes of paint rollers.

The pressure applied to the paint roller may further cause more pressure to be applied to the frame on the surface being painted. This in turn can prevent "kicking out", whereby the end caps become unconnected to the frame, which may occur if the frame ends move in an outward motion due to additional pressure being applied to the frame or the paint roller. The outward motion of the frame ends can be sufficient to cause the engagement means of the one or more of the end caps to become unconnected from one or more of the frame ends. For example, a stub shaft of an end cap may become unconnected and dislodged from the indentation in the frame end that the stub shaft had been fitted within. This can disrupt painting and can cause mistakes and irregularities in the painting process.

A paint roller may be disengaged and removed from a paint roller frame. As disclosed herein, to mount a paint roller to the frame of the present invention, the engagement means incorporated in the end caps connected to the paint roller may be engaged with the engagement means incorporated in the frame arms. For example, stub shafts in the end caps may be snapped into indentations in the frame arms. To dismount the paint roller from the frame, the engagement means of the end caps may be disengaged from the engagement means of the frame arms. For example, the stub shaft in the end cap connected to the paint roller may be snapped out of the indentations incorporated in the frame arms by a reverse of the connection steps discussed herein. The removal may involve a snap out of the end cap from the frame end, for example, so that the stub shaft snaps as it passes out of the indentation and through the narrow section at the top end of the indentation.

As such, the mounting and dismounting of the paint roller to and from the frame of the present invention may be described as a system that does not require the springing or flexing of the side arms in a direction that moves the arms to be farther apart from each other, as is required by the prior art. Moreover, embodiments of the present invention that are front loading involve mounting and dismounting of the roller in a manner whereby the paint roller is held in place within the frame.

In another embodiment of the paint roller system, the slit formed in an end of a frame arm may incorporate a cut-out section where the slit meets the top edge of the frame. This cut-out may prevent paint build-up from forming in the slit. Paint build-up can create a problem as it may leave residue on a wall or surface that the paint roller frame comes into contact with, such as may occur when the paint roller is connected to the paint roller frame and is in use. Paint build-up may further prevent a slit from widening and retracting as is described as part of an engagement means that may be incorporated in embodiments of the present invention. Such a cut-out where the slit means the top edge of the frame may particularly be incorporated in an embodiment of the present invention that includes a paint roller frame that is formed of a material that is not easily cleaned.

An example of an embodiment of the present invention, wherein only one end cap and frame end incorporate snappable engagement means, and the other end cap and frame end are connected by another form of engagement means, is disclosed herein. However, a skilled reader will recognize that the non-snappable engagement means disclosed herein is merely an example of one type of non-snappable engagement means that may be incorporated in embodiments of the present invention that include a snappable engagement means between only one of the end caps and frame arms. Other types of non-snappable engagement means may be incorporated in embodiments of the present invention.

Figure 21:
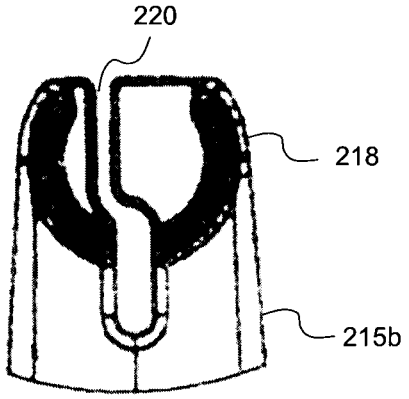
FIG. 21 is an interior side view of a frame end of the paint roller frame having a non-straight slit therein in accordance with an embodiment of the present invention.

In another embodiment of the paint roller system, the slit formed in an end of a frame arm may be formed to be a shape other than a straight slit. For example, as shown in FIG. 21, the non-straight slit 220 may incorporate a deviation from a straight line, such as to be of a z-style shape or another style or shape. A skilled reader will recognize that the slit may be formed to be a variety of shapes that are not straight lines in accordance with other embodiments of the present invention. The slit may be formed to separate two portions of the end of the frame arm 215*b*, and may further divide two portions of the end of the frame arm that incorporate an indentation 218.

Figure 26:
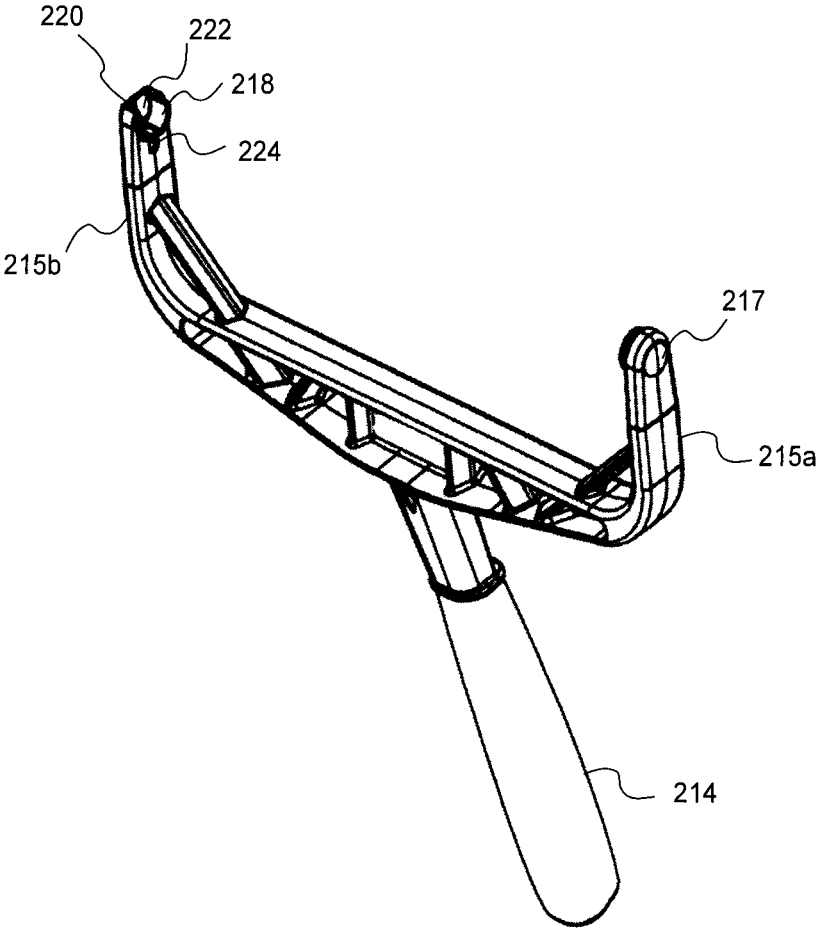
FIG. 26 is a side perspective view of the paint roller frame having a handle incorporated therein and a frame end with a non-straight slit therein in accordance with an embodiment of the present invention.

As shown in FIG. 26, the non-straight slit 220 in a frame end 215*b* may extend to a non-straight slit end point 224 below an indentation 218, for example, such as a virtually circular indentation. A side wall 222 may be incorporated in the frame end between the indentation and the exterior surface of the frame end. The frame end incorporating the non-straight slit may be incorporated in a paint roller frame that only incorporates one snap engagement means between a frame end and an end cap. A frame end 215*b* that incorporates the non-straight slit may be opposite a second frame end 215*a* that does not incorporate a non-straight slit, but does incorporate an indentation that exists within a frame end, but does not extend to any edge of the frame end, as disclosed in more detail herein.

Figure 19:
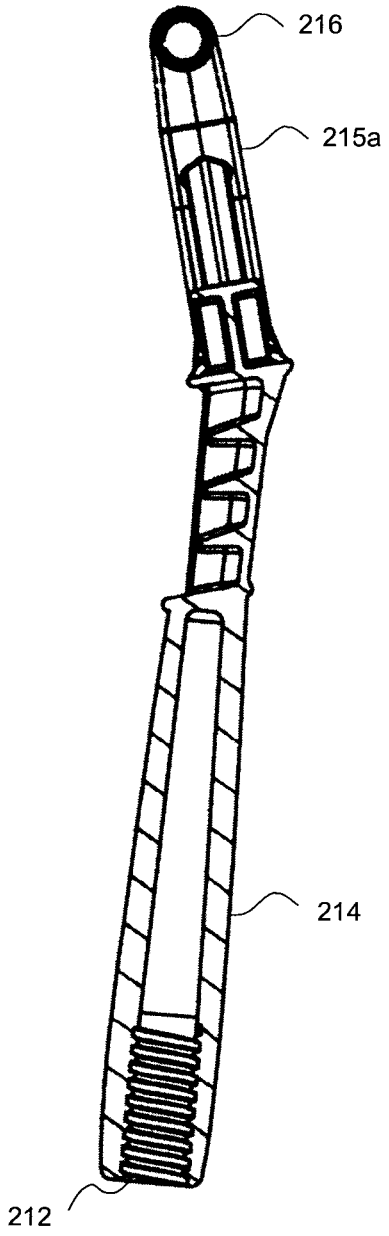
FIG. 19 is a side cross-sectional view of the paint roller frame having a handle incorporated therein in accordance with an embodiment of the present invention.
Figure 20:
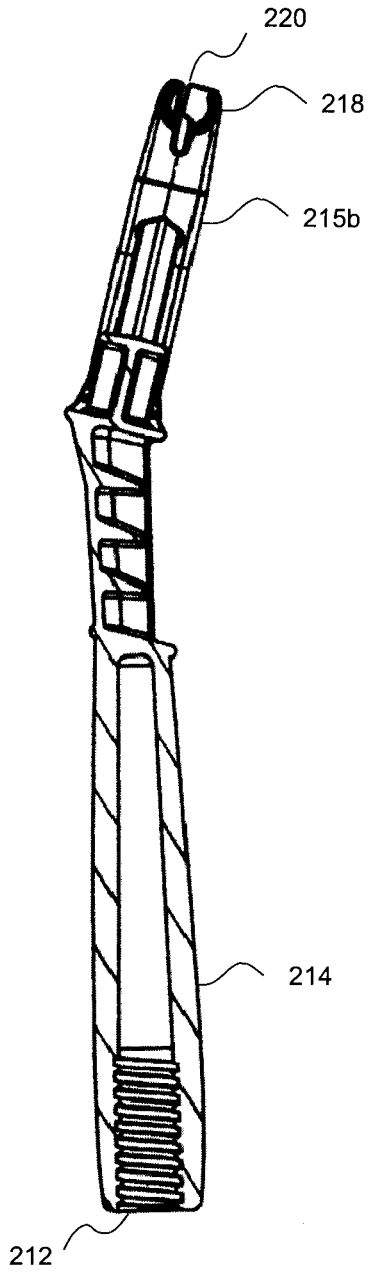
FIG. 20 is a side cross-sectional view of the paint roller frame having a handle incorporated therein and showing a frame end having a non-straight slit in accordance with an embodiment of the present invention.

Such an embodiment of the present invention may incorporate a handle portion 214. The handle portion 214 may further incorporate a threaded section 212 that may be utilized to attach an extension section or other section by a threaded connection, as shown in FIGS. 19 and 20.

Figure 28:
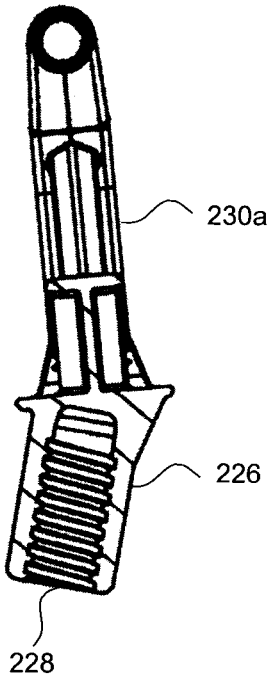
FIG. 28 is a side cross-sectional view of a paint roller frame having a threaded attachment element incorporated therein directly below the base section of the frame in accordance with an embodiment of the present invention.
Figure 29:
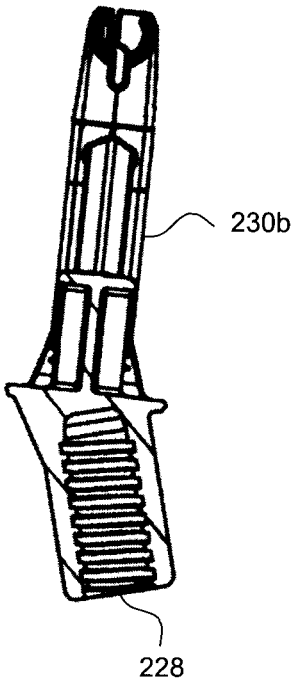
FIG. 29 is a side cross-sectional view of a paint roller frame having a threaded attachment element incorporated therein directly below the base section of the frame and a frame end having a non-straight slit therein in accordance with an embodiment of the present invention.
Figure 30:
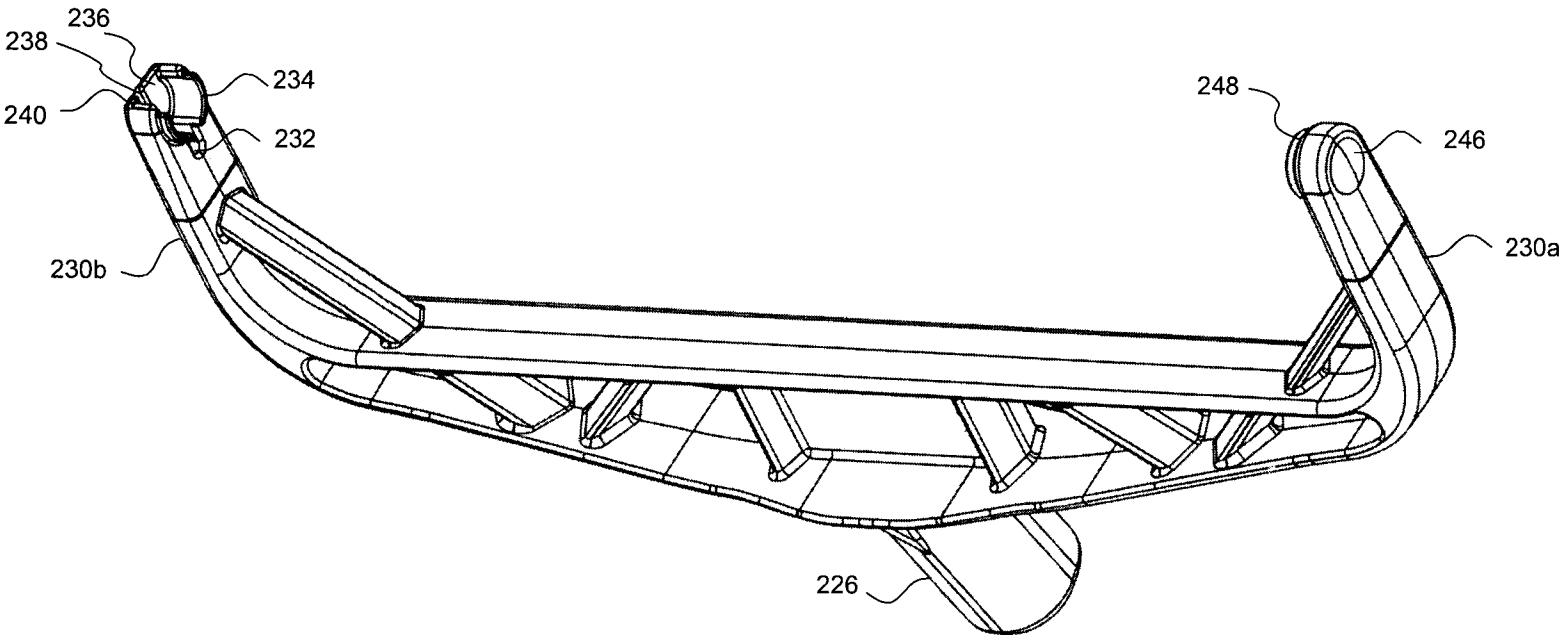
FIG. 30 is a side perspective view of a paint roller frame having a frame end with a non-straight slit therein in accordance with an embodiment of the present invention.

As shown in FIGS. 28 and 29, the paint roller frame may incorporate a threaded section 228 that extends up so as to terminate near to the base section of the frame that is positioned between the arms 230*a* and 230*b* of the paint roller frame. As shown in FIG. 30, the threaded section that extends so as to terminate near the base section of the paint roller frame may appear to an external viewer to be a column portion 226 incorporated in the paint roller frame.

As shown in FIG. 30, the non-straight slit 238 may separate two portions of the frame end 230*b* and the slit may be formed to be off-set from the centre of the width of the frame end at the outermost end of the frame end and thereby create unequally sized portions 236 and 240. An indentation 234 may be formed in the frame end that is divided by the slit, and the slit may extend to a slit point 232 beyond indentation. The indentation may be formed in the frame end so that the two portions 236 and 240 form side walls on the exterior surface of the frame and the indentation is formed in the frame end on the interior surface of the side walls and the indentation may even be extended beyond the frame end interior surface by way of a collar 242 that continues the indentation section beyond the interior surface of the frame end in the direction of the opposite frame end. The collar may be operable to increase the stability of the connection between the end cap stub shaft fitted into the indentation. The collar may further prevent the end cap stub shaft from becoming unconnected from the indentation when pressure is exerted on the paint roller while the paint roller is connected to the end cap and is inserted between the two frame ends. A skilled reader will recognize that the end cap stub shaft may of varying lengths to create a more secure connection between the paint roller frame and the end cap connected to the paint roller, so that the end cap is prevented from becoming unconnected from the paint roller frame when the paint roller is in use.

Figure 12:
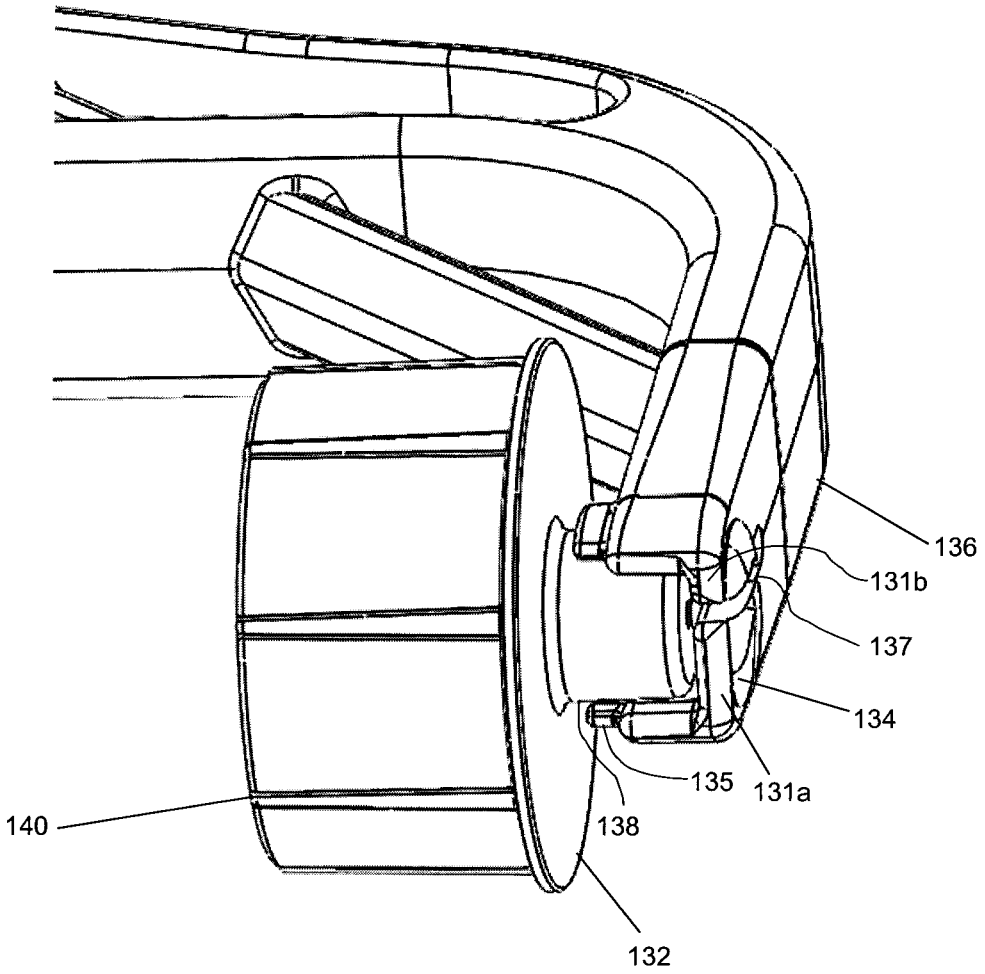
FIG. 12 is a top perspective view of end cap connected to a frame end of the paint roller frame having a non-straight split therein in accordance with an embodiment of the present invention.

As shown in FIG. 12, a cap end 132 may be connected to an end frame portion 136 with a non-straight slit 137 formed therein. A stub shaft 138 of an end cap may be inserted into the indentation so that a portion of the stub shaft extends beyond the collar section 135 of the indentation and the other end of the stub shaft is virtually parallel or is parallel with the two portions that form two walls 131*a* and 131*b* between the indentation and the exterior surface of the frame end.

Notably, the end cap may incorporate a connection means, such as one or more shafts 140 or ribs that protrude from the connection wall of the end cap, being the portion of the end cap that is fittable within the paint roller to engage with a portion of the interior wall of the paint roller. When the connection wall of the end cap is fitted within the paint roller a connection is created between the paint roller and the end cap. The one or more shafts or ribs may contact a portion of the interior wall of the paint roller and thereby create a tighter fit between the connection wall of the end cap and the interior wall of the paint roller than is achieved if there are no shafts or ribs formed in the end cap. The connection may be a type of frictional connection between the connection wall of the end cap and the paint roller that acts to sustain the connection of the paint roller and end cap, and to keep the paint roller from slipping in relation to the end cap. The paint roller may therefore be less wobbily and experience reduced slippage during use.

Figure 15B:
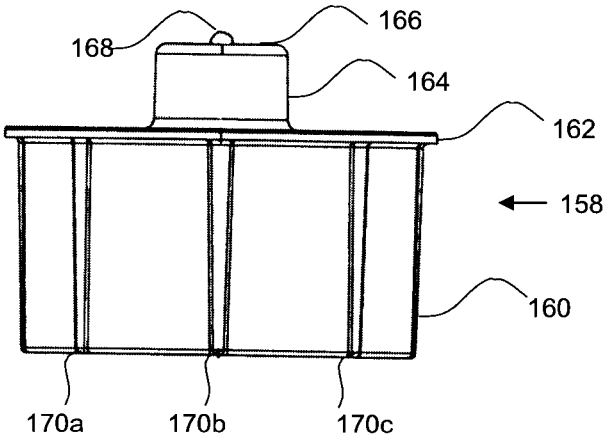
FIG. 15*b* is a side perspective view of an end cap incorporating a pivot point in accordance with an embodiment of the present invention.
Figure 16A:
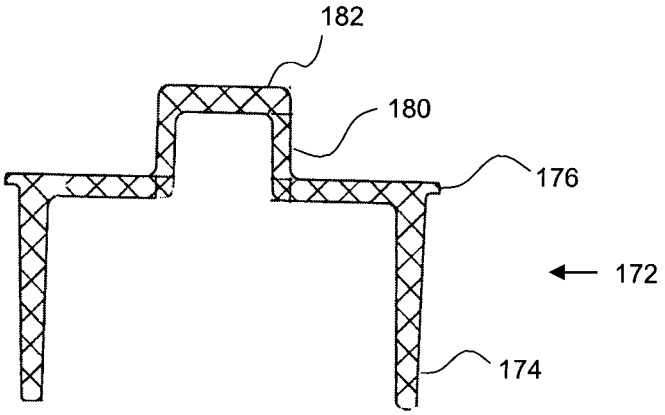
FIG. 16*a* is a side cross-sectional view of an end cap in accordance with an embodiment of the present invention.
Figure 16B:
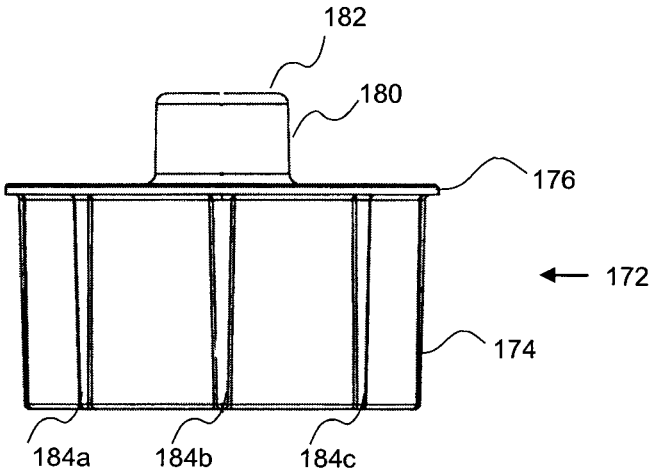
FIG. 16*b* is a side perspective view of an end cap accordance with an embodiment of the present invention.

Examples of shafts and ribs are shown in FIG. 16*b*. Protruding ribs 184*a*, 184*b*, 184*c* may be formed in the exterior surface of connection wall 174 of the end cap that fits within a paint roller. FIG. 15*b* shows another example of the ribs 170*a*, 170*b* and 170*c* formed on an end cap connection wall 158. A skilled reader will recognize that the number of shafts or ribs incorporated in an end cap may vary, and that an end cap may be formed without any such shafts or ribs incorporated therein. A skilled reader will further recognize that the length of the connection wall may be of various lengths to achieve varying levels of stability of the paint roller.

Figure 11:
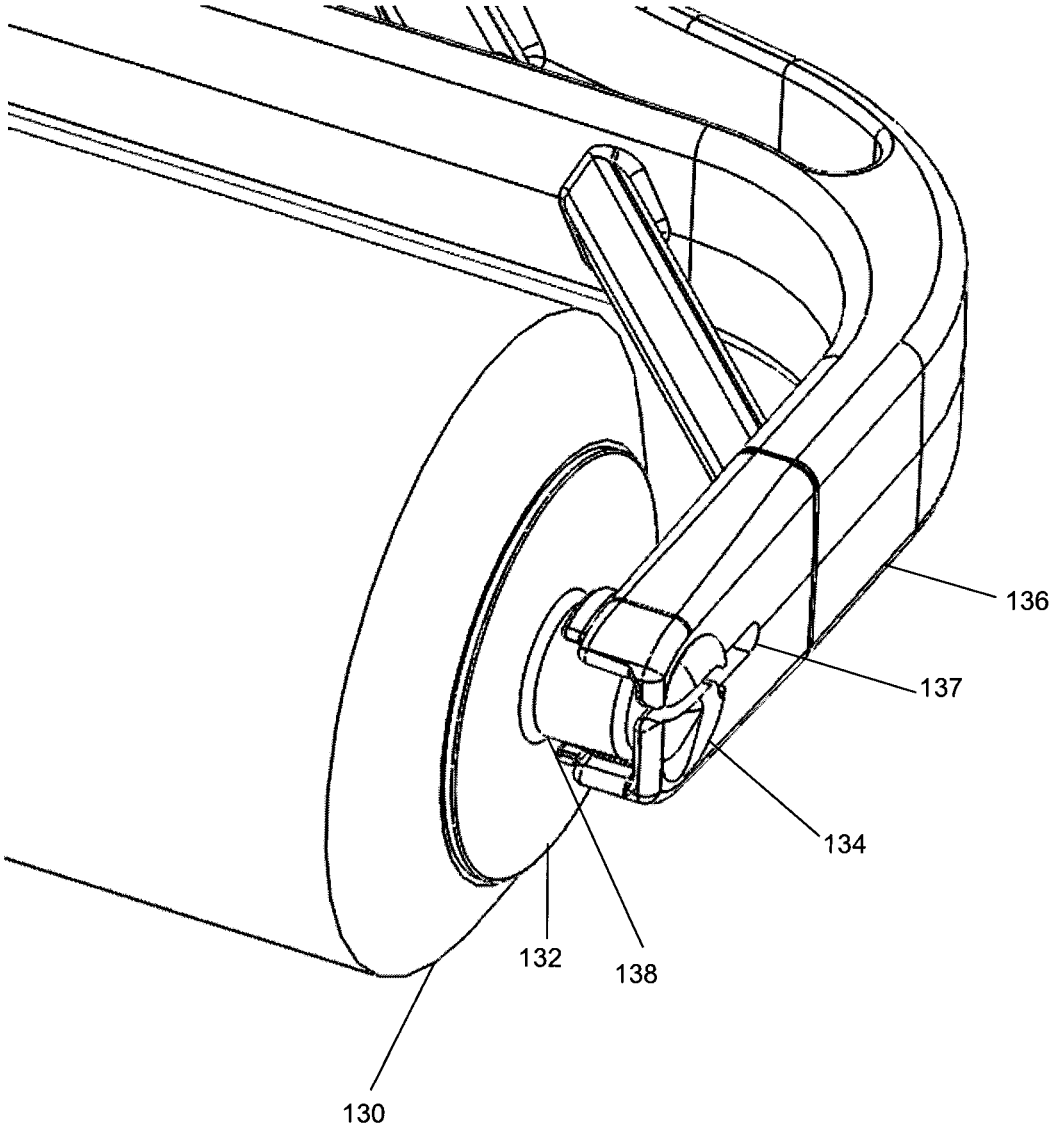
FIG. 11 is a top perspective view of a paint roller connected to a frame end of the paint roller frame having a non-straight split therein in accordance with an embodiment of the present invention.

As shown in FIG. 11, an end cap 132 may be connected with a paint roller 130 and the stub shaft 138 of the end cap may be connected into a frame end 136 of a paint roller frame that incorporates a non-straight slit 137. The exterior wall of the frame end may further incorporate a wall spacer portion 134, and this wall spacer portion may be divided by the non-straight slit into two portions that may be unequal in size and shape.

Figure 22:
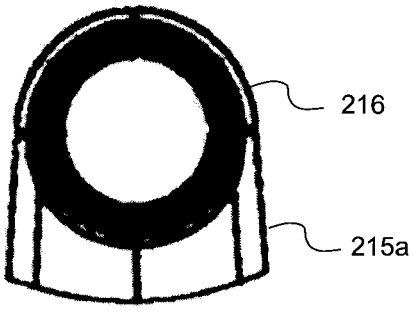
FIG. 22 is an interior side view of a frame end of the paint roller frame in accordance with an embodiment of the present invention.

As shown in FIG. 30, a frame end 230*a* positioned opposite the frame end incorporating a non-straight slit may incorporate an indentation, such as a circular indentation. As shown in FIGS. 22 and 26, the circular indentation 216 may be formed in the wall of the frame end 215*a* that is opposite the indentation with a slit formed in the other frame end 215*b* of the same frame. The two types of indentations formed in opposing frame end of the frame and positioned so as to face each other. Each of the indentation with a slit and the circular indentation are formed so that a stub shaft of an end cap may be inserted therein. As shown in FIG. 30, in one embodiment of the present invention the circular indentation may incorporate a circular collar 246 that extends beyond the interior surface of the frame end wherein the circular indentation is formed and extends towards the opposite frame end incorporating the non-straight slit. This circular collar may be operable to increase the stability of the connection between the end cap post or stub shaft fitted into the circular indentation. The collar may further prevent the end cap post or stub shaft from coming unconnected from the circular indentation when pressure is exerted on the paint roller when the paint roller is connected to the end cap and inserted between the two frame ends.

A skilled reader will recognize that the frame end that does not incorporate a slit and is not a snappable engagement means may incorporate a variety of types of engagement means. The circular indentation is just an example of one possible engagement means that may be incorporated in embodiments of the present invention.

When a paint roller is connected to end caps, so that one end cap is connected to each end of the paint roller, a stub shaft of each end cap will extend beyond each end of the paint roller, as shown in FIG. 1. Each of these stub shafts of the end caps can be inserted into an engagement means of one of the frame ends of the paint roller frame. In one embodiment of the present invention, one end cap can be inserted into the circular indentation formed in one of the frame ends. Once this insertion is complete, the other end cap can be inserted into the indentation with the slit in the other frame end by a snappable engagement, as described herein. The slit will allow for flexibility and give by widening and retracting in response to levels of tension so that a snapable connection is created between the end cap stub shaft and the indentation with a slit in the frame end. As shown in FIG. 11, the post 138 of the end cap 132 will fit within the indentation after the snappable connection is achieved.

As shown in FIG. 22, the circular indentation 216 may not meet any edge of the frame end, so that the circular indentation is surrounded by edges of the frame end and is wholly incorporated within the frame end. This aspect of the circular indentation can increase the stability of the indentation, and prevent a cap end stub shaft inserted into the circular indentation from slipping out of the circular indentation during use of the paint roller system.

Figure 18B:
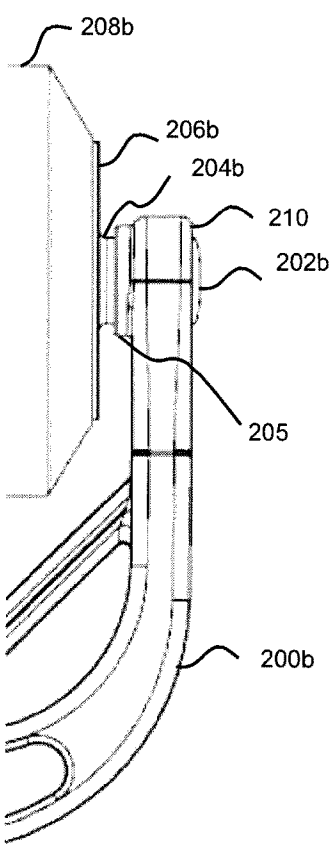
FIG. 18*b* is a side cross-sectional view of an end cap connected to a paint roller and to a frame end of the paint roller frame having a wall spacer element therein in accordance with an embodiment of the present invention.

As shown in FIG. 18*b*, the whole of the circumference of a first stub shaft 204*b* of a first end cap 206*b* connected to a first end of a paint roller 208*b* may be inserted into and encircled by the circular indentation including the circular indentation collar 205 formed in a first arm 200*b* of a paint roller frame. Whereas, a portion of the circumference of a second stub shaft 204*a* of a second end cap 206*a* connected to a second end of a paint roller 208*a* may not be completely encircled by the indentation with a slit including the indentation collar 203 formed in a second arm 200*a* of a paint roller frame. As described herein, the first end cap stub shaft and end frame are connected initially, and the second end cap stub shaft and end frame a connected by a snap connection subsequently. The outcome is that the paint roller is positioned between two end caps that are connected to the paint roller frame, so that the paint roller may be utilized within the paint roller frame to apply paint to surfaces.

The paint roller frame may be connectable to end caps that incorporate pivot points in the stub shafts. As shown in FIGS. 16*a* and 16*b*, an end cap 172 may be formed to incorporate a connection wall 174 that is fittable within the interior of a paint roller. The connection wall may incorporate one or more protruding ribs 184*a*, 184*b*, 184*c*, or shafts, as described herein. An outer edge 176 of the end cap may be formed so that it will be flush or virtually flush with the end of the paint roller into which the end cap is inserted and incorporated, as described herein. This assists with preventing paint or other liquid from entering the interior of the paint roller.

The outer edge 176 of the end cap is connected to the connection wall, but the outer edge may extend beyond the circumference of the connection wall, to form a flange that protrudes past the connection wall. The circumference of the outer edge may therefore be greater or larger than the circumference of the connection wall. Both the outer edge and the connection wall may be generally circular in shape, however, the outer edge is not as deep as the connection wall. The connection wall may be shaped to be tube-like in configuration. The outer edge is not shaped to be tube-like, but rather may be formed so as to be a relatively flat circular shape, excepting where the stub shaft is formed near the central area of the outer edge, and may be shape to cover one end of the tube-like shape of the connection wall, as shown in FIGS. 16*a* and 16*b*.

A stub shaft 180 is formed in the outer edge and the stub shaft may have an exterior shaft portion 182 that may be positioned parallel or virtually parallel to the exterior wall of either the circular indentation or indentation with a slit therein in a frame end that the stub shaft is inserted within. The exterior shaft portion may come into contact with the exterior wall of either the circular indentation or indentation with a slit therein in a frame end into which the post is inserted while pressure is exerted upon the paint roller.

Figure 15A:
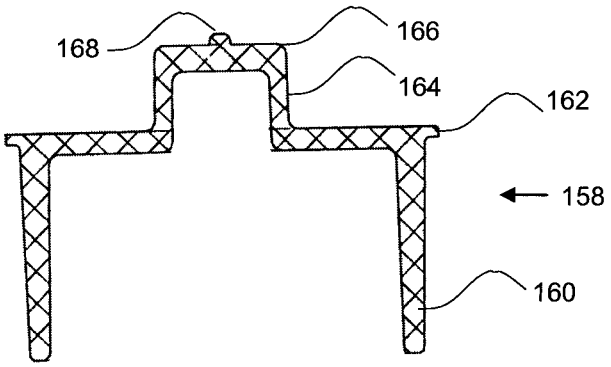
FIG. 15*a* is a side cross-sectional view of an end cap incorporating a pivot point in accordance with an embodiment of the present invention.

In another embodiment of the present invention, an exterior shaft portion may incorporate a pivot point 168, as shown in FIGS. 15*a* and 15*b*. An end cap 158 may incorporate a connection wall 160 that may further have one or more ribs 170*a*, 170*b*, 170*c* or ribs formed therein. For example, an end cap may incorporate one rib or shaft, or multiple ribs or shafts. An end cap that incorporates multiple ribs or shafts may be configured so that the ribs or shafts are equi-distant from each other, unequally spaced from each other, or arranged in any order. The ribs or shafts may further be all equi-sized, or may be of varying sizes. The ribs or shafts may be configured to create a tight fit between the paint roller and the end cap, and to prevent the paint roller from slipping or wobbling when it is connected to the paint roller frame and particularly while it is in use.

The outer edge portion 162 of the end cap may have an end cap stub shaft 164 incorporated therein having an exterior shaft section 166 that incorporates a pivot point 168. The pivot point may be a section that protrudes from the exterior post section, such as a semi-circular protrusion.

Figure 17B:
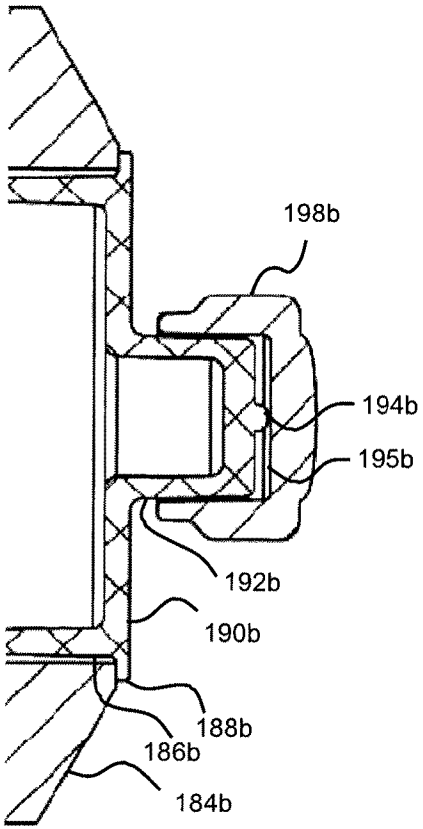
FIG. 17*b* is a side cross-sectional view of an end cap with a pivot point connected to a paint roller and a frame end of the paint roller frame in accordance with an embodiment of the present invention.
Figure 17A:
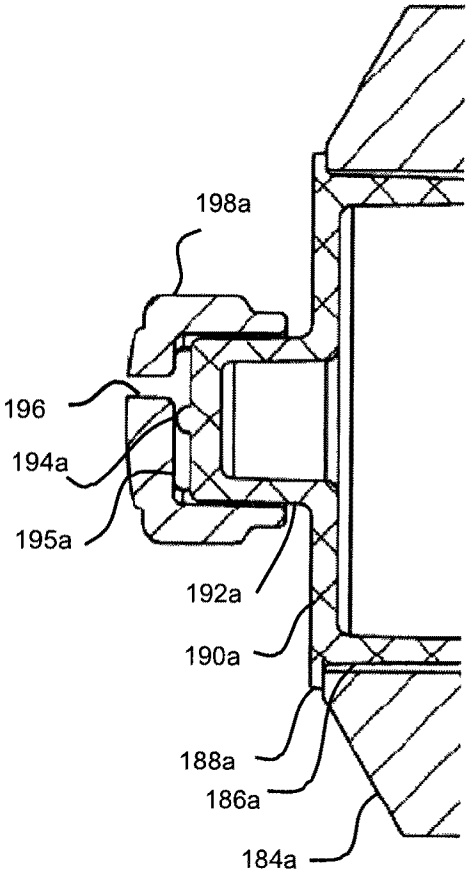
FIG. 17*a* is a side cross-sectional view of an end cap with a pivot point connected to in a paint roller and to a frame end of the paint roller frame having a non-straight split therein in accordance with an embodiment of the present invention.

As shown in FIGS. 17*a* and 17*b*, the pivot points 194*a* and 194*b* formed in end caps may create a point of connection between exterior end walls 195*a* and 195*b* of the frame end incorporating an indentation with a slit therein and a circular indentation respectively. Thus, as the only point of connection is the pivot point, any friction between the end cap and frame end is reduced from the possible friction created if a larger surface where in contact with the frame end. The result may be that there is less resistance created by the connection occurring between the stub shaft pivot point and the frame end. In some instances the paint roller connected to the end caps may essentially spin on either or both of the pivot points.

As shown in FIG. 17*b*, a first end of the paint roller 184*b* may be connected to a first end cap 190*b* having an outer edge portion 188*b* that fits so as to be flush or virtually flush with the end of the first end of the paint roller. The first shaft section 192*b* of the first end cap within a circular indentation, so that the first shaft section is encircled by the wall 198*b* of the circular indentation.

As shown in FIG. 17*a*, a second end of the paint roller 184*a* may be connected to a second end cap 190*a* having an outer edge portion 188*a* that fits so as to be flush or virtually flush with the end of the second end of the paint roller. The second shaft section 192*a* of the second end cap is fit within an indentation 196 having a slit therein, so that the first shaft section is virtually encircled by the indentation walls 198*a* of the indentation with a slit therein.

In one embodiment of the present invention, the slit may be positioned to be off-set from the pivot point when the end cap is connected to the frame end with a slit therein. The pivot point is therefore not inserted into the slit. For example, the slit is offset from the centre of the side wall 195*a* so that the pivot point that is virtually centrally located connects with a portion of the side wall that does not incorporate the slit. If the pivot point ends up connecting with the slit this can inhibit the rotation of the paint roller. Thus, by off-setting the pivot point and the slit to ensure these two elements do not connect, the rotation of the paint roller is not negatively affected, but is instead improved. A skilled reader will recognize that there are a variety of configurations of embodiments of the present invention that may ensure that the pivot point and does not connect with the slit in a frame end.

Figure 18A:
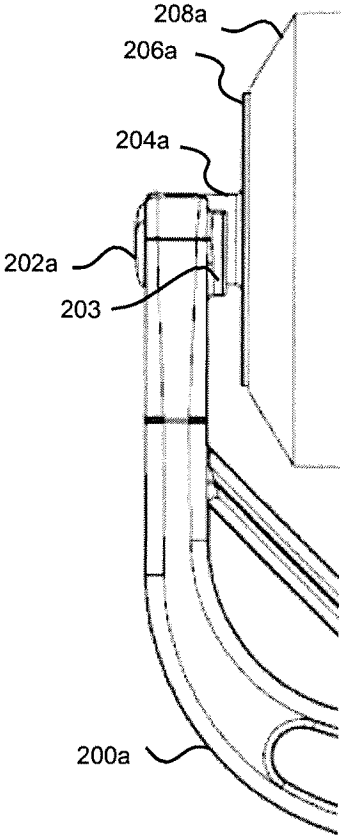
FIG. 18*a* is a side cross-sectional view of an end cap connected to a paint roller and to a frame end of the paint roller frame having a non-straight split and a wall spacer element therein in accordance with an embodiment of the present invention.
Figure 23:
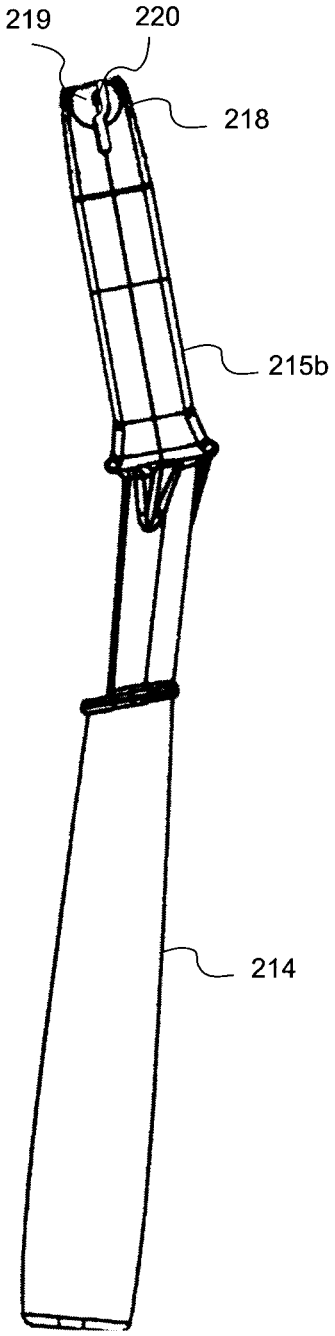
FIG. 23 is a side view of the paint roller frame having a handle incorporated therein and showing a frame end having a non-straight slit in accordance with an embodiment of the present invention.
Figure 24:
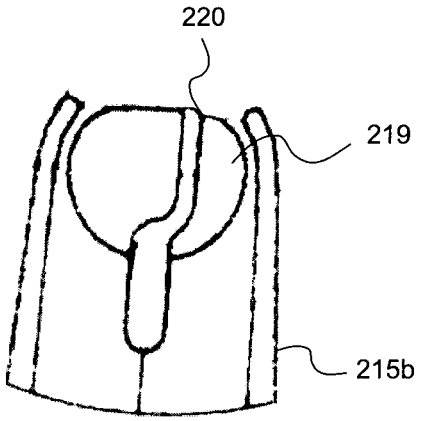
FIG. 24 is an exterior side view of a frame end of the paint roller frame having a non-straight slit therein in accordance with an embodiment of the present invention.
Figure 25:
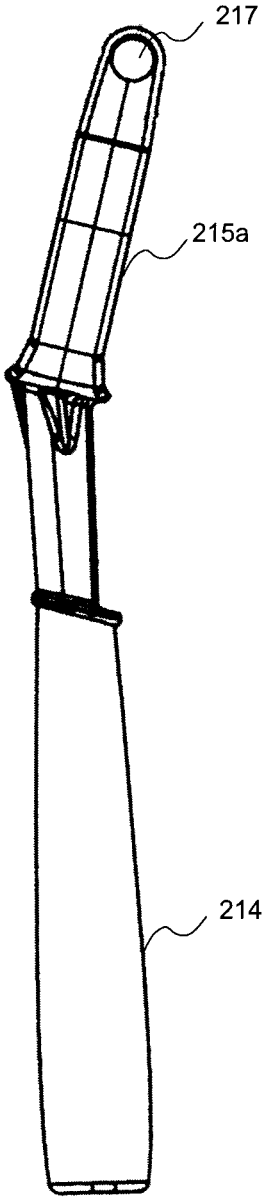
FIG. 25 is a side view of the paint roller frame having a handle incorporated therein in accordance with an embodiment of the present invention.

As shown in FIGS. 18*a* and 18*b*, both of the frame ends in a paint roller frame may incorporate a wall spacer portion 202*a* and 202*b*. The wall spacer is shown to be circular, but a skilled reader will recognize that it may be any shape. The wall spacer protrudes from the exterior surface of the frame end. As shown in FIGS. 23 and 24, a wall spacer 219 formed in a frame end 215*b* incorporating a non-straight slit 220 or any other shaped slit, including a straight slit, may be divided into two portions by said slit. Whereas a wall spacer 217 formed in a frame end 215*a* that does not incorporate any type of slit remains wholly intact.

Figure 27:
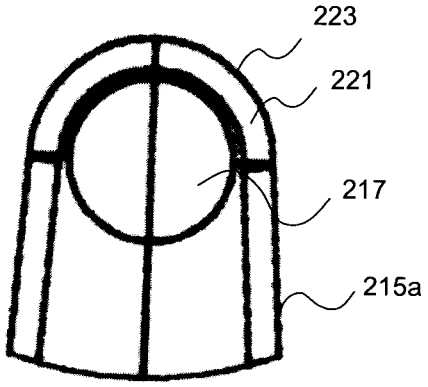
FIG. 27 is an exterior side view of a frame end of the paint roller frame having a wall spacer therein in accordance with an embodiment of the present invention.

Furthermore, the wall spacer may be positioned near the edge of the frame end, but there may be a space 210 between the edges of the frame end and the edges of the wall spacer. As shown in FIG. 27, the frame end 215*a* may include a space 221 that is level with the other portions of the frame end near the edge of its exterior surface 223, and the wall spacer 217 may be positioned so it is not flush with any outer edge of the frame end, but instead so that a section of the frame end exists between the outer edge of the frame end and the wall spacer.

The wall spacer may be formed to be a protrusion that incorporates a gradual slope towards an apex of the protrusion, or may be formed in another configuration. The apex of the wall spacer should protrude from the wall of the frame end so as to be sufficiently distant therefrom so that when the wall spacer is in contact with a wall or surface no other portion of the paint roller frame will be in contact with the same wall or surface. The wall spacer thereby prevents scrubbing.

The wall spacer may be operable to prevent the paint roller frame and the frame arms in particular from contacting a surface, such as a wall that the paint roller system is utilized near. For example, if the paint roller system is utilized in a corner section of a wall, so that the paint roller is in contact with one wall, the wall spacer will prevent the arms of the paint roller frame from contacting the wall that is also near the paint roller frame due to the corner which causes the second wall to be near the roller at a 45 degree angle or another angle, or any other positioning of walls or surfaces that may cause the paint roller frame to be likely to contact multiple walls while it is being used to apply paint to one wall. The wall spacer may contact a surface, but it will prevent any other portion of the paint roller frame from contacting the same surface. Contact with a surface by the paint roller frame directly may scratch, remove paint, or otherwise caused damage to the surface. Therefore, the wall spacer acts to protect surfaces during painting undertaken by utilizing embodiments of the present invention.

Embodiments of the present invention may incorporate one or more end cap holders the end cap may be inserted in for storage purposes. The end cap holders may be incorporated in the paint roller frame and may be fixedly incorporated therein or removeably incorporated therein. The end cap holders may be operable to hold an end cap either while the paint roller is attached to the paint roller frame, such as when the paint roller is in use, or when the paint roller is detached from the paint roller frame, such as when the paint roller is not in use.

Figure 13:
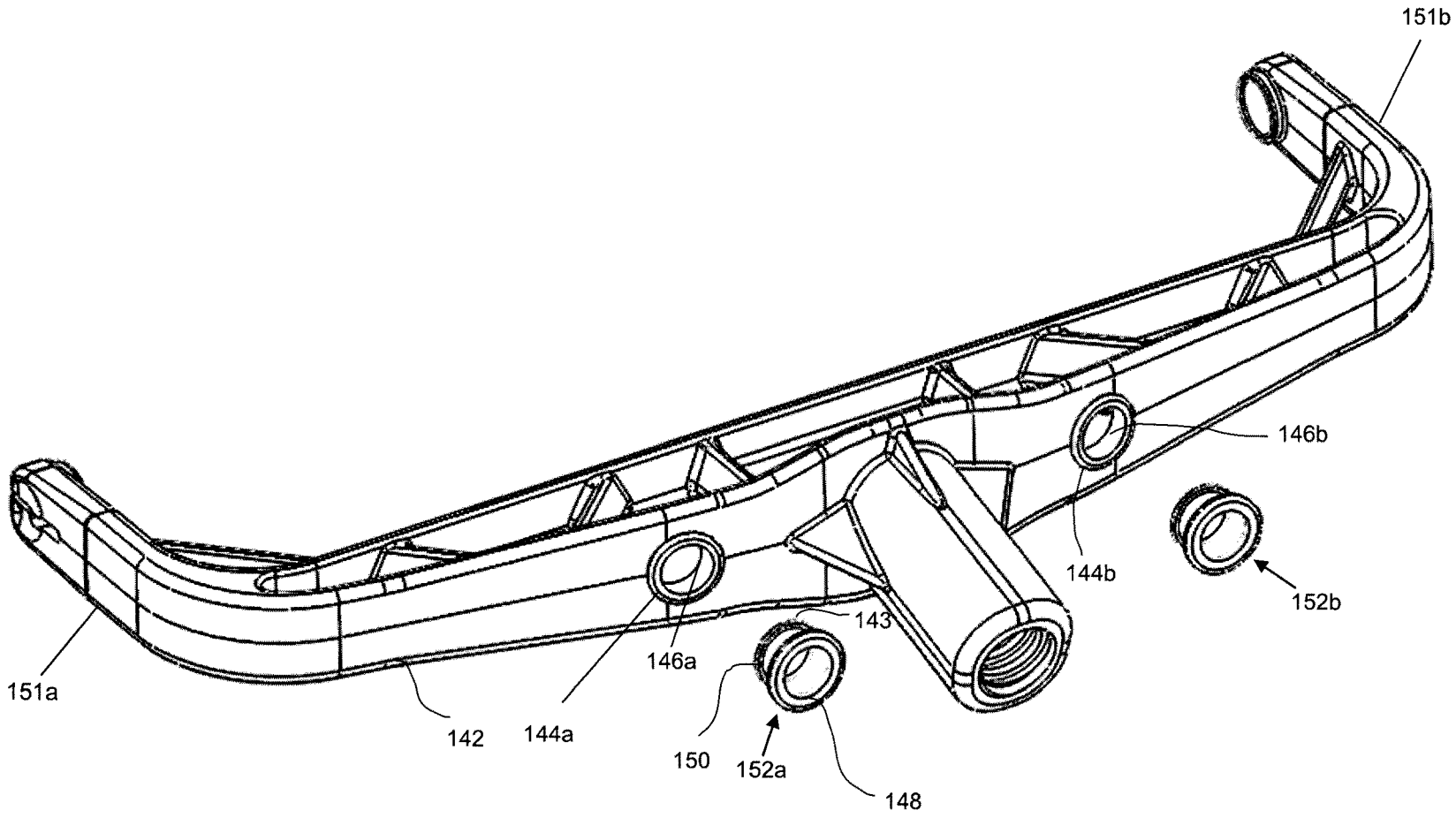
FIG. 13 is a top perspective view of a paint roller frame having end cap holders connected to the base section of the frame in accordance with an embodiment of the present invention.
Figure 14:
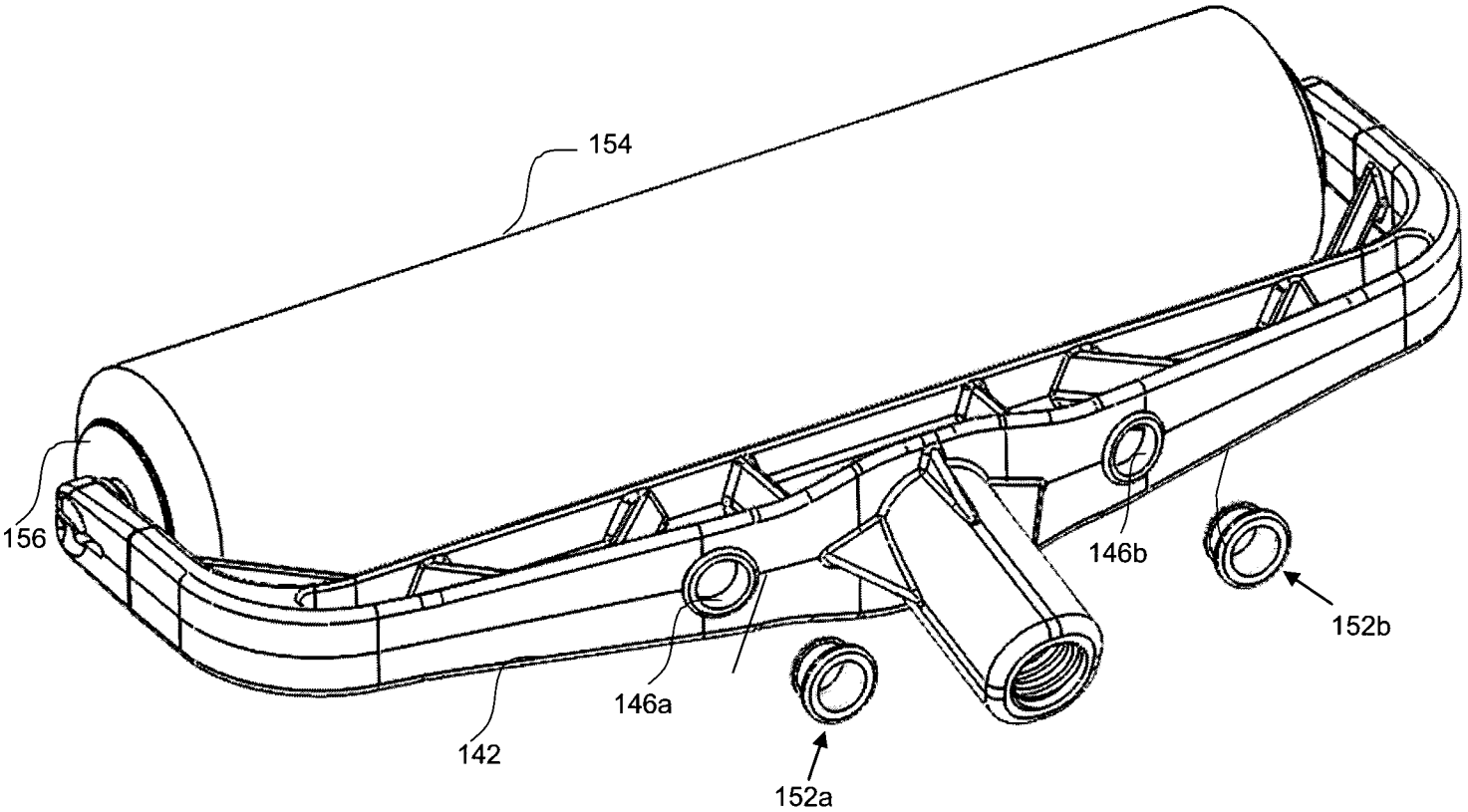
FIG. 14 is a top perspective view of a paint roller connected to the paint roller frame that has end cap holders in the base section of the frame in accordance with an embodiment of the present invention.

In one embodiment of the present invention, as shown in FIGS. 13 and 14, end cap holders may be configured to include one or more holes 144*a* and 144*b* formed in base portion of the paint roller frame 142 that extends between the two paint roller arms 151*a* and 151*b*. Each hole may be formed to include an inner wall 146*a* and 146*b* that extends through the whole of the base portion of the paint roller frame.

Each of the holes 144*a* and 144*b* may further have a liner 152*a* and 153*b* inserted therein, so that when inserted into the hole the exterior surface of the liner is in contact with the inner wall of the hole. The contact should be sufficient tight that the liner will remain in position within the hole once inserted. The liner protectors may be formed of a material that will cause the liner to remain positioned within the holes even when an end cap is not being held in the end cap holder. For example, the liner may be formed of a material that is tacky, flexible, repressable and expandable, or will by another means create a close and sufficiently tight bond between an end cap inserted into the hole, for example, such as rubber, plastic, polymer blend materials, materials with expandable fillers, or any other material.

One or more lips 148 and 143 may be formed on one or more ends of the liner, so that the one or more lips will remain outside of the hole, and will act to hold the liner in place. If a lip is formed on an end of the liner that has to be inserted into and through the hole, such as lip 143 shown in FIG. 13, said lip may be configured to be of a size that is insertable into the hole so that it may be pushed through the hole and out the far side of the hole. Once inserted the lip will sit outside the hole. Pushing the liner with the lip through the hole may require some force. Any of the lips in a liner may be in contact with the exterior surface of the paint roller frame when the liner is inserted into a hole. The position, shape and size of the one or more lips may be configured to prevent the liners from falling out of the holes.

The exterior surface of the liner may be shaped so as to fit within a hole. The interior surface of a liner may be of any shape, such as circular, hexagonal, square, ribbed or any other shape, that will accept an end cap inserted in to the interior of the liner and hold the end cap in position in a removeable manner. The shape of the interior surface of a liner may be specifically formed to create a tight, but removeable, hold upon an end cap inserted into the interior surface of the liner.

An end cap may be inserted into the hole by either the post end or the connection end, depending on the size and configuration of the end cap holder.

The liners may be operable so that they can be removed and replaced should build-up of paint or coatings collect on the liners so as to cause the end caps to no longer fit therein.

As shown in FIG. 14, the end cap holders may be in use when a paint roller 154 is connected to the paint roller frame by end cap 156 connections.

The holes of the end cap holders are formed to be shaped and sized in accordance with the specific embodiment of the present invention. The holes will therefore be shaped and sized to removeably retain an end cap within a combination of the hole and a liner and hold it in position until the end cap is removed from the end cap holder.

Figure 31:
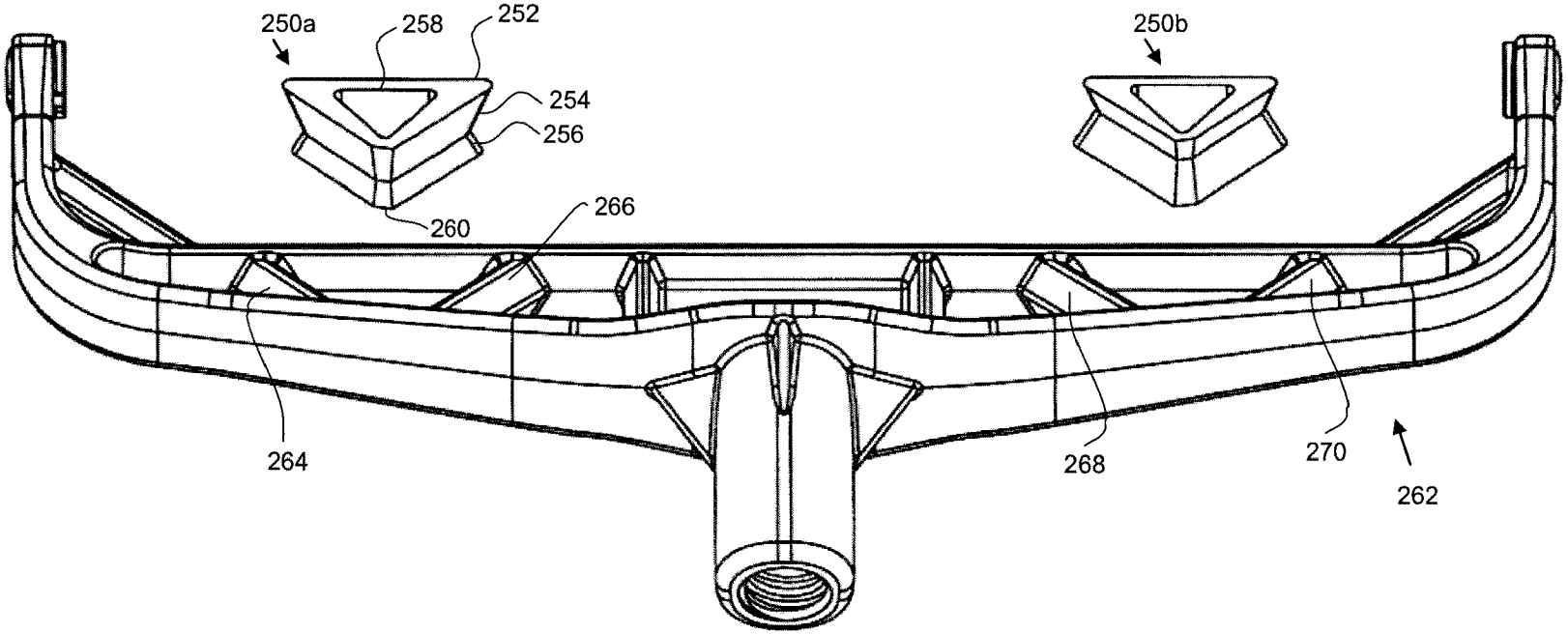
FIG. 31 is a side perspective view of a paint roller frame having end cap holders with triangular interior cut-outs therein in accordance with an embodiment of the present invention.
Figure 32:
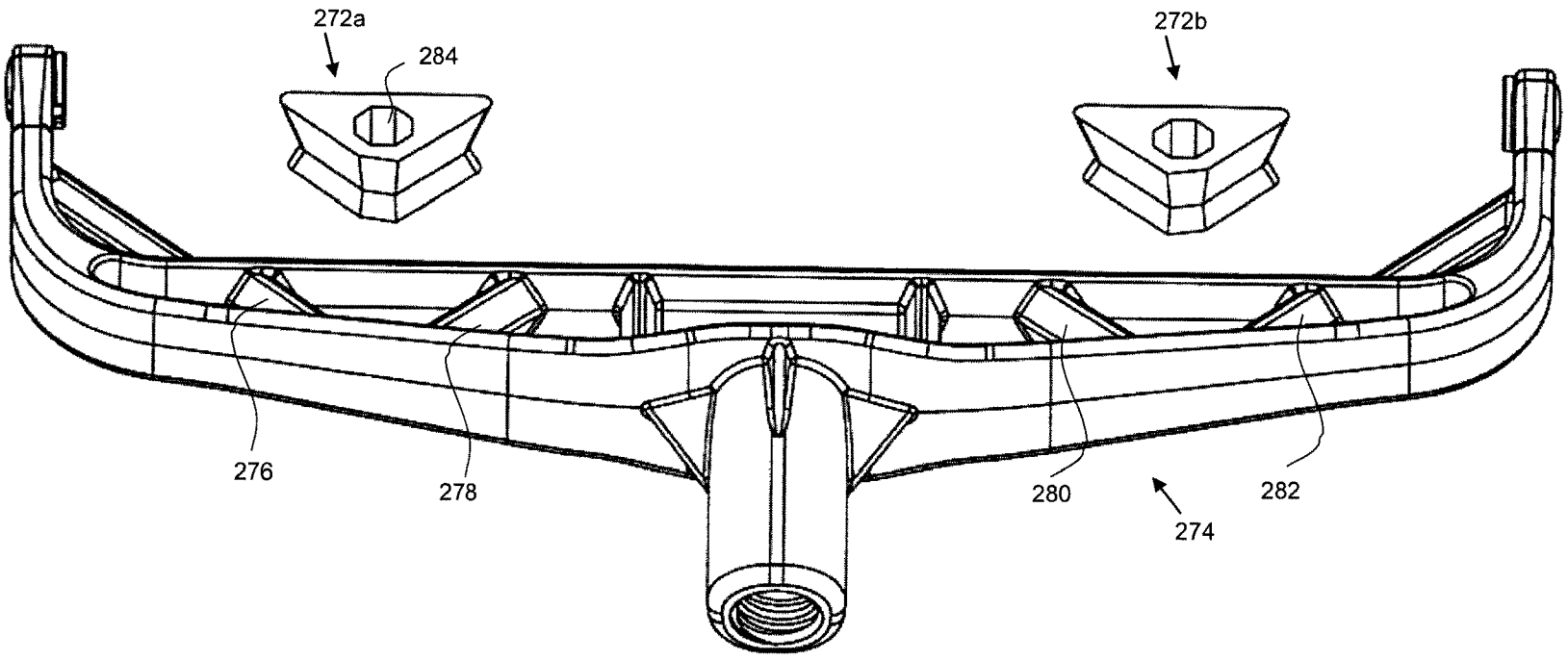
FIG. 32 is a side perspective view of a paint roller frame having end cap holders with hexagonal interior cut-outs therein in accordance with an embodiment of the present invention.
Figure 33:
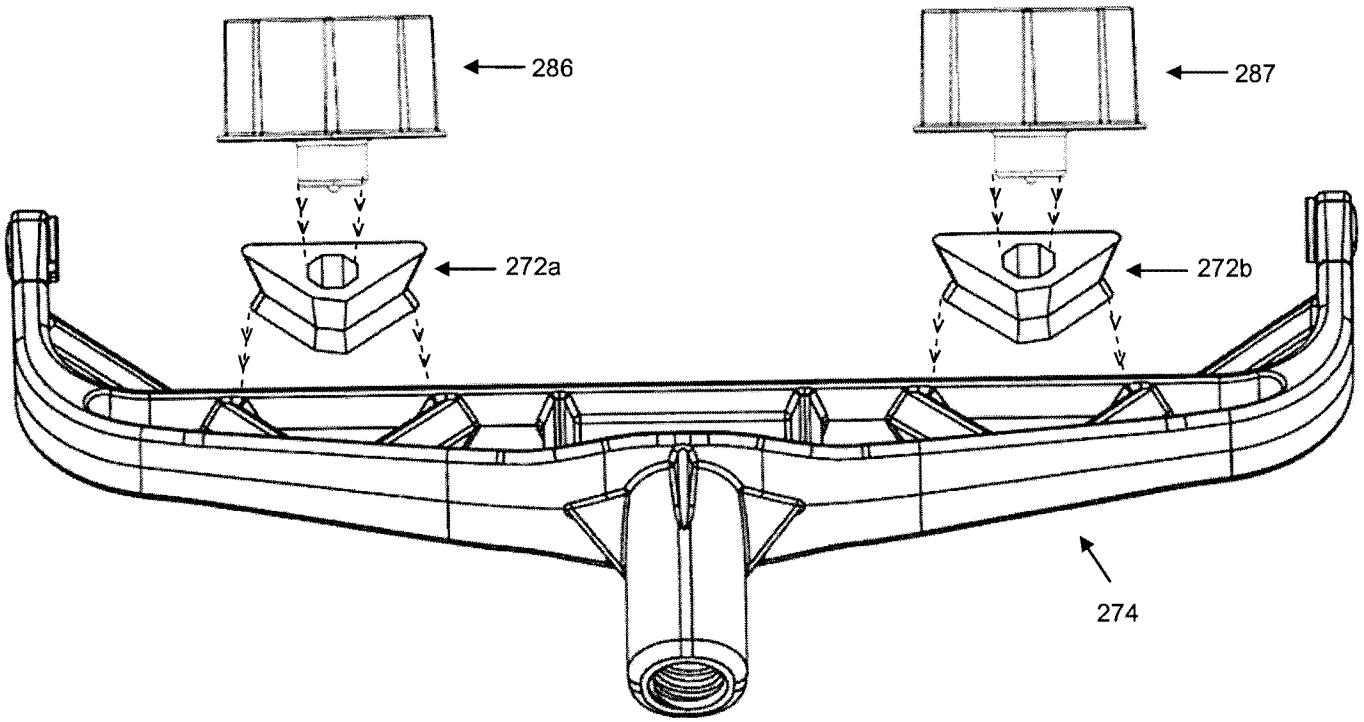
FIG. 33 is a side perspective view of a paint roller frame having end cap holders with hexagonal interior cut-outs therein and showing end caps fittable within the interior cut-outs in accordance with an embodiment of the present invention.

In another embodiment of the present invention, as shown in FIGS. 31, 32 and 33, end cap holders may be formed to be removeably attached between reinforcement portions of the paint roller frame and portions of the paint roller frame that extend between the reinforcement portions. As shown in FIG. 31, the end cap holders 250*a* and 250*b* may be shaped so as to be insertable between reinforcement portions 264, 266, 268, and 270. For example, as the reinforcement portions shown in FIG. 31 create a triangular type shape with the paint roller frame, the end cap holders may be shaped to be near to triangular in shape. As shown in FIG. 31, the reinforcement portions and portions of the paint roller frame existing between the reinforcement portions do not create an exact triangle. Therefore, the shape of the end cap holder may incorporate further shaping portions 260 that cause the shape of the end cap holder to match the space where it will be inserted into with the paint roller frame. A skilled reader will recognize that the shape of the end cap holders may vary in accordance with the shape formed between the reinforcement portions and the portion(s) of the paint roller frame that extend between such reinforcement portions, where the end cap holder is to be positioned.

The shape and configuration of the end cap holder should be such that the end cap holder will contact the reinforcement portions and portions of the paint roller frame extending between the reinforcement portions, wherein the end cap holder is inserted once insertion is completed. The combination of the shape of the end cap holders and the contact with the paint roller frame portions, including the reinforcement portions, should be sufficient to hold the end cap holder in place once inserted. The shape of the end cap holders should further be configured to prevent paint or coating from becoming trapped between the outer walls of the end cap holder and the reinforcement portions and portions of the paint roller frame that the end cap holder outer walls are in contact with. However, the contact and shape of an end cap holder should also be such that the end cap holder is removable from the paint roller frame once it is inserted.

The end cap holder may further have a first portion 254 and a second portion 256 that slope in opposite directions, or that are otherwise sloped to create a secure fit between the end cap holder and the reinforcement portions and portions of the paint roller frame that the end cap holder will be in contact with once it is inserted within the paint roller frame. The sloped first portion and second portion may prevent the end cap holder from slipping when it is inserted in the paint roller frame, as the slopes may be specifically formed in accordance with the shape of the walls of the reinforcement portions and portions of the paint roller frame that the end cap holder will contact once it is inserted within the paint roller frame. A skilled reader will recognize the many configurations that may be possible for the end cap holders in accordance with the shape of the reinforcement portions and the portions of the paint roller frame that the end cap holder is to be in contact with once it is inserted into to the paint roller frame.

Each end cap holder incorporates a cut-out in its body, which may be of various shapes, such as a triangular shape cut-out 258. The shape of the cut-out should be chosen so that an end cap inserted into the end cap holder will be held in position in a removable manner.

In another embodiment of the present invention, as shown in FIGS. 32 and 33, end cap holders 272*a* and 272*b* may be formed to be insertable between reinforcement portions 276 and 278, and 280 and 282, respectively, of the paint roller frame 274. Each end cap holder may incorporate a hexagonal shape cut-out 284. An end cap may be inserted into the cut-out section of the end cap holders and will be held in position in the end cap holder until the end cap is removed from the holder.

As shown in FIG. 33, the end cap holders 272*a* and 272*b* may be inserted into the paint roller frame, as indicated by the arrows. Additionally the stub shafts of end caps 286 and 287 may each be inserted in one of the end cap holders, as indicated by the arrows. For example, end cap 286 is insertable into end cap holder 272*a*, and end cap 287 is insertable into end cap holder 272*b*. Once inserted in the end cap holder the end caps should be firmly held in position until the end caps are pulled or otherwise removed from the end cap holders.

An end cap may be inserted into the cut-outs of the end cap holders by either the stub shaft end or the connection wall end, and the size and shape of the cut-outs may be formed specifically in accordance with the stub shaft end or connection wall end of the end cap that is to be inserted into said cut-out. An end cap may be formed of a variety of materials capable of holding the end cap in place, such as, tacky materials, rubber, plastic, polymer blend materials, materials that are repressable and expandable, and any other material that can be shaped as required for the configuration of the end cap holders.

A skilled reader will recognize that a variety of configurations of end cap holders are possible and may be incorporated in embodiments of the present invention.

The end cap holders offer a benefit over the prior art that does not include end cap holders. In embodiments of the present invention that incorporate end holders, end caps, which are necessary for the assembly and function of the present invention, may be stored with the paint roller frame. This causes the elements of the paint roller system to be storable together, which leads to no time being spent searching for the elements of the present invention prior to use. The end cap holders of embodiments of the present invention therefore represent a significant benefit of convenience and potential time-savings.

Figure 10:
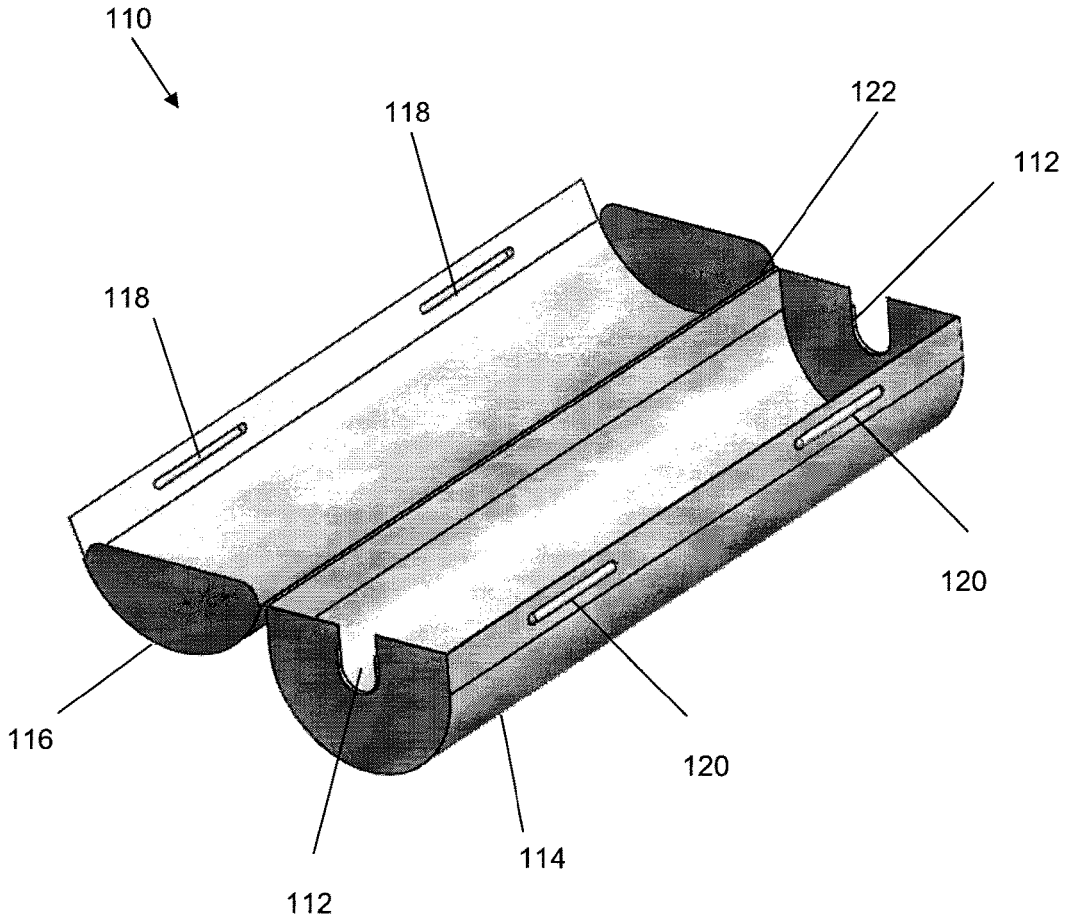
FIG. 10 is a top perspective view of a paint roller container in accordance with an embodiment of the present invention.

The paint roller system of the present invention may further incorporate a paint roller container. The paint roller container may be shaped to receive and enclose a paint roller. An example of a paint roller container 110 is shown in FIG. 10. The paint roller container may include slots 112 formed in the side walls, and aspects of the engagement means of end caps incorporated in a paint roller may be positioned within the slots when a paint roller is received in the paint roller container. For example, stub shafts, that may be incorporated in engagement means formed in end caps, that are connected to a paint roller may be positioned in the slots. A skilled reader will recognize that a variety of shapes of slots may be formed in the paint roller container to accommodate various engagement means that may be formed in end caps of the present invention.

The paint roller container may be formed to create a hollow interior when it is in a closed position. In an open position, as shown in FIG. 10, the paint roller container may include two portions, a roller portion 114 wherein a paint roller may be positioned, and a lid portion 116. The lid portion may enclose the paint roller within the interior of the paint roller container when the lid portion is in a closed position. The lid portion and the roller portion may be connected by a hinge portion 122 or other flexible connection, whereby the lid portion and roller portion may be moved between an open and closed position without becoming entirely disengaged from each other.

In a closed position the lid portion and roller portion may be connected by an attachment means at the edges of the lid portion and roller portion that are distant from the hinge connection between the lid portion and the roller portion. When in a closed position the lid portion and roller portion may be positioned so as to fully encompass the paint roller. For example, the attachment means may include one or more recessed formations 118 or grooves formed in the lid portion and one or more ridges 120 formed in the roller portion to receive and engage with the recessed formations. A skilled reader will recognize that a variety of other attachment means may be formed in the lid portion and the roller portion to cause the lid portion and the roller portion to be attached to each other in a closed position.

The attachment means may create a releasable connection between the lid portion and the roller portion. The attachment means may create a connection that is sufficient to keep the paint roller held securely within the paint roller container when the paint roller container is in a closed position.

The paint roller container included in the paint roller system of the present invention may reduce the mess encountered by the user undertaking to change a paint roller. The paint roller may be positioned in the paint roller container. The paint roller container may be closed so as to enclose the paint roller within the container. The paint roller may be disengaged from the frame, so that the engagement means of the end pieces and the frame ends are disconnected, when the paint roller is in the paint roller container and the paint roller container is either in an open or closed position. The paint roller may be disengaged from the frame by applying force to the back of the roller from the backside of the roller. Alternatively, the paint roller may be disengaged from the frame by applying force to the side of the frame. The user may not be required to make direct contact with the paint roller, or apply significant force (such as banging the frame or the roller) in order to disengage the paint roller form the frame.

The frame may also be engaged with a paint roller that is enclosed in a paint roller container through a reverse method of attaching the engagement means of the frame arms and the end pieces as is described for the disengagement of the frame arms and paint roller herein. As with the disengagement method, a user may not need to come into direct contact with the paint roller in order to position the paint roller within the frame. The engagement means of the end pieces incorporated in the paint roller and the engagement means of the frame arms may be connected by the application of force to the frame once it is positioned in respect to the paint roller within the paint roller container so that the engagement means of the end pieces and the engagement means of the frame arms may be engaged through the application of force.

The paint roller container may be formed of a variety of liquid resistant materials, including any plastic or metals. The paint roller container may be formed of a material that is useable in cold temperatures, such as various plastic materials. In one embodiment of the present invention the paint roller container may be placed in cold storage, for example, such as in a refrigerator, when a paint roller is stored inside the paint roller container. The paint roller container may be stored in cold temperatures to protect the paint roller or any paint that remains on the paint roller when it is stored in the paint roller container. The paint roller may be stored in the paint roller container with paint on the paint roller in the instance that multiple colours of paint are being used by a user, and the user is required to change paint rollers to apply various colours of paint to a surface during various points during a painting project.

The paint roller container may be formed of a clear material, such as a clear plastic material, to allow a user to see the paint roller enclosed within the paint roller container. Visibility of the paint roller within a paint roller container may be useful, for example, such as if a user is utilizing a variety of paint rollers in a painting project and needs to see a paint roller in order to know if it is the paint roller that the user requires at a particular point in time during the project. The ability to see the paint roller within the paint roller container may allow the user to know which paint roller is contained in which paint roller container, or to identify details about the paint roller contained within a paint roller container without having to open the paint roller container. Therefore, the user will not need to come into contact with the paint roller container, or risk coming into contact with the paint roller enclosed within a paint roller container and any paint or other substance that may be on the paint roller, such as may occur if the paint roller container is required to be opened by the user to see the paint roller inside the paint roller container. In this manner the paint roller container may avoid undue mess, and may make locating a particular paint roller or ascertaining details about a paint roller a faster process than if it is necessary to open one or more paint roller containers to ascertain information about a paint roller.

The paint roller container may be formed of a material that is resistant to corrosive substances, for example, such as paint, chemical solvents, bases and acids. In one embodiment a paint roller cleaner solution may be introduced in the roller portion of the paint roller container. When the paint roller is positioned within the paint roller container the solution may contact the paint roller and may clean the roller. The roller may be rotated within the paint roller container by the engagement means of the end pieces that may extend through the slots to be wholly or partially external to the paint roller container, so that an engagement means of at least one of the end pieces extends beyond the outside of at least one of the side walls of the paint roller container.

It will be appreciated by those skilled in the art that other variations of the preferred embodiment may also be practiced without departing from the scope of the invention.

What is claimed is:

1. A paint roller system for applying a liquid material to a surface, said paint roller system comprising:

(a) a frame devoid of moving parts incorporating a first frame arms and a second frame arm that are connected at one end, a first frame engagement means on the first frame arm and a second frame engagement means on the second frame arm, said frame arms being positioned to be virtually parallel to each other;

(b) a paint roller having an end piece incorporated in each of two outer roller ends that are positioned virtually parallel to each other, the end pieces being operable to prevent liquid from entering the paint roller, each end piece incorporating an end engagement means connectable to the frame engagement means of at least one of the two frame arms, a first end piece having a first end engagement means and a second end piece having a second end engagement means, the paint roller being positionable between the frame arms when the first and second end engagement means are connected to the first and second frame engagement means respectively and are freely rotatable in said position;

(c) the first frame arm including a top edge and an inner side wall and an outer side wall, a first indentation incorporated in the inner side wall said first indentation having a shape and size to receive the first end engagement means, a slit formed in the outer side wall and extending from said top edge to a location that is at least adjacent to said first indentation; and (d) a handle attachment incorporated in the frame extending from the end connecting the frame arms.

2. The paint roller system of claim 1, wherein the second frame engagement means and the second end engagement means are shaped to removably and rotatably connect to one another when the paint roller is inserted into the frame with the second end engagement means inserted into the second frame engagement means and the first end engagement means is inserted into the first frame engagement means.

3. The paint roller system of claim 2, wherein the second frame engagements means and the first frame engagement means having a different shape from one another, the second frame engagement means having a second indentation that is sized and shaped to removably receive a second stub shaft on the second engagement means.

4. The paint roller system of claim 2, wherein the second end engagement means and the first end engagement means have an identical size and shape.

5. The paint roller system of claim 1, wherein the frame incorporates any of struts, cutouts or reinforcement pieces, or any combination thereof, that are formed and incorporated in the frame to maintain rigidity and flexibility requisite to cause even weight distribution from the frame to the surface, so that there is even distribution of the liquid material to the surface with minimal force exerted by a user.

6. The paint roller system of claim 1, wherein the paint roller system is resistant to corrosion or plugging by any liquid material it contacts, including any of the following; paint, solvents, acid, water, bases, or any other agents that come into contact with the paint roller system.

7. The paint roller system of claim 1, wherein:

(a) the first end engagement means incorporates a first stub shaft; the first end engagement means being connectable to the first frame engagement means, the second end engagement means incorporating a second stub shaft and being connectable to the second frame engagement means;

(b) the first indentation of the first frame engagement means having a shape and size to receive the first stub shaft; and (c) the second frame engagement means incorporating a second indentation that is sized and shaped to rotatable and removably receive the second stub shaft of the second end engagement means.

8. The paint roller system of claim 7, wherein the first indentation is formed to be narrower than the first stub shaft at the end where the first stub shaft is introduced to the first indentation when the first end attachment means is connected to the first frame engagement means.

9. The paint roller system of claim 1, wherein the slit is formed in an outer portion of the first frame arms so that the slit extends into at least a portion of the first frame attachment means, said slit flexes the first frame arm by widening when the first frame engagement means is connected to or disconnected from the first end engagement means and returns to its original size after the connection or the disconnection has occurred, said slit being operable to prevent the paint roller from slipping or unexpectedly disengaging when the paint roller is positioned within the frame.

10. The paint roller system of claim 1, wherein the connection between the first end engagement means and the first frame engagement means is a snap connection.

11. The paint roller system of claim 1, wherein the paint roller is connected to the frame by front-loading and may be connected through force applied to the frame when the paint roller is positioned in proximity to the ends of the frame arms distant from the connection of the frame arms in the frame.

12. The paint roller system of claim 1, wherein the end pieces are formed of polypropylene resin.

13. The paint roller system of claim 1, wherein the paint roller is rotatable freely around an axis of the end pieces when the paint roller is connected to the frame, and the paint roller is rotatable in a clockwise direction and in a counter-clockwise direction.

14. The paint roller system of claim 1, wherein a paint roller container is formed to enclose and encompass the paint roller when the paint roller is not in use and the paint roller is positioned within the paint roller container.

* * * * *